US006914609B2

(12) United States Patent
Tang et al.

(10) Patent No.: US 6,914,609 B2
(45) Date of Patent: Jul. 5, 2005

(54) MULTIPLE SCAN LINE SAMPLE FILTERING

(75) Inventors: Yan Yan Tang, Mountain View, CA (US); Wayne Eric Burk, San Jose, CA (US); Philip C. Leung, Fremont, CA (US)

(73) Assignee: Sun Microsystems, Inc., Santa Clara, CA (US)

( * ) Notice: Subject to any disclaimer, the term of this patent is extended or adjusted under 35 U.S.C. 154(b) by 108 days.

(21) Appl. No.: 10/085,636

(22) Filed: Feb. 28, 2002

(65) Prior Publication Data

US 2003/0160789 A1 Aug. 28, 2003

(51) Int. Cl.[7] ..... G09G 5/36

(52) U.S. Cl. ..... 345/557; 345/530; 345/537; 345/552

(58) Field of Search ..... 345/530, 537, 345/549, 552, 557, 440, 611, 418–419, 613

(56) References Cited

U.S. PATENT DOCUMENTS 5,943,060 A * 8/1999 Cosman et al. ..... 345/613
6,326,964 B1 * 12/2001 Snyder et al. ..... 345/419
6,424,343 B1 7/2002 Deering et al.
6,459,428 B1 10/2002 Burk et al.

* cited by examiner

*Primary Examiner*—Matthew C. Bella
*Assistant Examiner*—Po-Wei Dennis Chen
(74) *Attorney, Agent, or Firm*—Meyertons Hood Kivlin Kowert & Goetzel, P.C.; Jeffrey C. Hood

(57) ABSTRACT

A system and method for generating pixels for a display device. The system may include a sample buffer for storing a plurality samples in a memory, a sample cache for caching recently accessed samples, and a sample filter unit for filtering one or more samples to generate a pixel. The generated pixels may then be stored in a frame buffer or provided to a display device. The method operates to take advantage of the common samples shared by neighboring pixels in both the x and y directions for reduced sample buffer accesses and improved performance. The method involves reading samples from the memory that correspond to pixels in a plurality of neighboring scan lines, and possibly also to multiple pixels in each of these scan lines. The samples may be stored in a cache memory and then accessed from the cache memory for filtering. The method maximizes use of the common samples shared by neighboring pixels in both the x and y directions.

17 Claims, 26 Drawing Sheets

Zoom factor = 2, delta = 0.5
filter radius = 1

For Non-Buddy Mode:

| binIn1v [1:0] \ sample [1:0] | 0 | 1 | 2 | 3 |
|---|---|---|---|---|
| 0 | a | b | c | d |
| 1 | c | d | a | b |
| 2 | d | c | b | a |
| 3 | b | a | d | c |

Where a, b, c, d identify different interleave bus to 3DRAM

For Buddy Mode:

| binIn1v [1:0] \ sample [2:0] | 0 | 1 | 2 | 3 | 4 | 5 | 6 | 7 |
|---|---|---|---|---|---|---|---|---|
| 0 | a | a | b | b | c | c | d | d |
| 1 | c | c | d | d | a | a | b | b |
| 2 | d | d | c | c | b | b | a | a |
| 3 | b | b | a | a | d | d | c | c |

Where a, b, c, d identify different interleave bus to 3DRAM

MULTIPLE SCAN LINE SAMPLE FILTERING

BACKGROUND OF THE INVENTION

1. Field of the Invention

This invention relates generally to the field of computer graphics and, more particularly, to a high performance graphics system which implements super-sampling.

2. Description of the Related Art

A computer system typically relies upon its graphics system for producing visual output on the computer screen or display device. Early graphics systems were only responsible for taking what the processor produced as output and displaying that output on the screen. In essence, they acted as simple translators or interfaces. Modern graphics systems, however, incorporate graphics processors with a great deal of processing power. They now act more like coprocessors rather than simple translators. This change is due to the recent increase in both the complexity and amount of data being sent to the display device. For example, modern computer displays have many more pixels, greater color depth, and are able to display images that are more complex with higher refresh rates than earlier models. Similarly, the images displayed are now more complex and may involve advanced techniques such as anti-aliasing and texture mapping.

As a result, without considerable processing power in the graphics system, the CPU would spend a great deal of time performing graphics calculations. This could rob the computer system of the processing power needed for performing other tasks associated with program execution and thereby dramatically reduce overall system performance. With a powerful graphics system, however, when the CPU is instructed to draw a box on the screen, the CPU is freed from having to compute the position and color of each pixel. Instead, the CPU may send a request to the video card stating: "draw a box at these coordinates". The graphics system then draws the box, freeing the processor to perform other tasks.

Generally, a graphics system in a computer (also referred to as a graphics system) is a type of video adapter that contains its own processor to boost performance levels. These processors are specialized for computing graphical transformations, so they tend to achieve better results than the general-purpose CPU used by the computer system. In addition, they free up the computer's CPU to execute other commands while the graphics system is handling graphics computations. The popularity of graphical applications, and especially multimedia applications, has made high performance graphics systems a common feature of computer systems. Most computer manufacturers now bundle a high performance graphics system with their systems.

Since graphics systems typically perform only a limited set of functions, they may be customized and therefore far more efficient at graphics operations than the computer's general-purpose central processor. While early graphics systems were limited to performing two-dimensional (2D) graphics, their functionality has increased to support three-dimensional (3D) wire-frame graphics, 3D solids, and now includes support for three-dimensional (3D) graphics with textures and special effects such as advanced shading, fogging, alpha-blending, and specular highlighting.

While the number of pixels is an important factor in determining graphics system performance, another factor of equal import is the quality of the image. Various methods are used to improve the quality of images, including anti-aliasing, alpha blending, and fogging, among numerous others. While various techniques may be used to improve the appearance of computer graphics images, they also have certain limitations. In particular, they may introduce their own aberrations and are typically limited by the density of pixels displayed on the display device.

As a result, a graphics system is desired which is capable of utilizing increased performance levels to increase not only the number of pixels rendered but also the quality of the image rendered. In addition, a graphics system is desired which is capable of utilizing increases in processing power to improve graphics effects.

Prior art graphics systems have generally fallen short of these goals. Prior art graphics systems use a conventional frame buffer for refreshing pixel/video data on the display. The frame buffer stores rows and columns of pixels that exactly correspond to respective row and column locations on the display. Prior art graphics system render 2D and/or 3D images or objects into the frame buffer in pixel form, and then read the pixels from the frame buffer during a screen refresh to refresh the display. Thus, the frame buffer stores the output pixels that are provided to the display. To reduce visual artifacts that may be created by refreshing the screen at the same time as the frame buffer is being updated, most graphics systems' frame buffers are double-buffered.

To obtain images that are more realistic, some prior art graphics systems have gone further by generating more than one sample per pixel. In other words, some graphics systems implement super-sampling whereby the graphics system may generate a larger number of samples than exist display elements or pixels on the display. By calculating more samples than pixels (i.e., super-sampling), a more detailed image is calculated than can be displayed on the display device. For example, a graphics system may calculate 4, 8 or 16 samples for each pixel to be output to the display device. After the samples are calculated, they are then combined or filtered to form the pixels that are stored in the frame buffer and then conveyed to the display device. Using pixels formed in this manner may create a more realistic final image because overly abrupt changes in the image may be smoothed by the filtering process.

As used herein, the term "sample" refers to calculated information that indicates the color of the sample and possibly other information, such as depth (z), transparency, etc., of a particular point on an object or image. For example, a sample may comprise the following component values: a red value, a green value, a blue value, a z value, and an alpha value (e.g., representing the transparency of the sample). A sample may also comprise other information, e.g., a z-depth value, a blur value, an intensity value, brighter-than-bright information, and an indicator that the sample consists partially or completely of control information rather than color information (i.e., "sample control information").

When a graphics system implements super-sampling, the graphics system is typically required to read a plurality of samples, i.e., sample data, corresponding to the area or support region of a filter, and then filter the samples within the filter region to generate an output pixel. This typically requires a large number of reads from the sample memory. Therefore, improved methods are desired for more efficiently accessing sample data from the sample memory in order to generate output pixels for a sample buffer, frame buffer and/or a display device.

SUMMARY OF THE INVENTION

One embodiment of the invention comprises a system and method for generating pixels for a display device. The system may include a sample buffer for storing a plurality samples in a memory, a sample cache for caching recently accessed samples, and a sample filter unit for filtering one or more samples to generate a pixel. The generated pixels may then be stored in a frame buffer or provided to a display device. The method operates to take advantage of the common samples shared by neighboring pixels in both the x and y directions for reduced sample buffer accesses and improved performance.

The method may involve reading a first portion of samples from the memory. The first portion of samples may correspond to pixels in a plurality of (at least two) neighboring scan lines. The first portion of samples may be stored in a cache memory and then accessed from the cache memory for filtering.

The sample filter unit may then operate to filter a first subset of the first portion of samples to generate a first pixel in a first scan line. The sample filter unit may also filter a second subset of the first portion of samples to generate a second pixel in a second scan line, wherein the second scan line neighbors the first scan line. The first subset of the first portion of samples may include a plurality of common samples with the second subset of the first portion of samples. Thus the method may operate to reduce the number of accesses required to be made to the sample buffer. Where the sample filter unit is configured to access samples for greater than 2 neighboring scan lines, the sample filter unit may also access the requisite samples from the cache and filter other subsets of the first portion of samples to generate additional pixels in other scan lines.

The sample filter unit may also be operable to generate additional pixels neighboring the first and second pixels in the x direction (in the first and second scan lines) based on the read. In this case, the sample filter unit may access a third subset of the first portion of samples from the cache memory and filter the third subset of samples to generate a third pixel in the first scan line, wherein the third pixel neighbors the first pixel in the first scan line. The sample filter unit may access a fourth subset of the first portion of samples from the cache memory and filter the fourth subset of samples to generate a fourth pixel in the second scan line, wherein the fourth pixel neighbors the second pixel in the second scan line.

The above operation may then be repeated for multiple sets of pixels in the plurality of scan lines, e.g., to generate all pixels in the first and second scan lines. For example, the method may then involve reading a second portion of samples from the memory, wherein the second portion of samples corresponds to pixels in the at least two neighboring scan lines, wherein the second portion of samples neighbors the first portion of samples. The sample filter unit may filter a first subset of the second portion of samples to generate a third pixel in the first scan line, and may filter a second subset of the second portion of samples to generate a fourth pixel in the second scan line. The third pixel may neighbor the first pixel in the first scan line, and the fourth pixel may neighbor the second pixel in the second scan line. The first subset of the second portion of samples may include a plurality of common samples with the first subset of the first portion of samples, and the second subset of the second portion of samples may include a plurality of common samples with the second subset of the first portion of samples.

Thus the sample filter unit may proceed by generating pixels in multiple neighboring scan lines, e.g., generating a pair of pixels in neighboring scan lines in the x direction, one pair at a time. This operates to more efficiently use the sample memory accesses in the generation of pixels.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
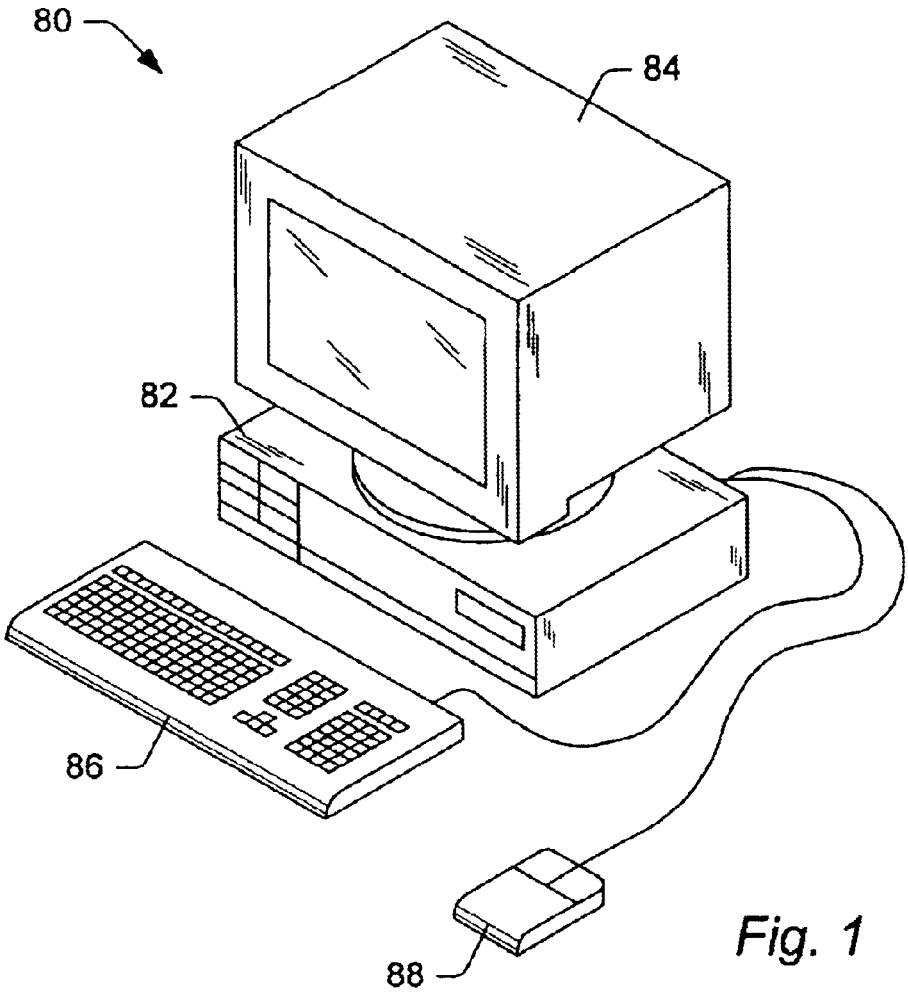
FIG. 1 is a perspective view of one embodiment of a computer system.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must)." The term "include", and derivations thereof, mean "including, but not limited to". The term "connected" means "directly or indirectly connected", and the term "coupled" means "directly or indirectly connected".

DETAILED DESCRIPTION OF THE EMBODIMENTS

Incorporation by Reference

The following applications are hereby incorporated by reference in their entirety as though fully and completely set forth herein.

U.S. patent application Ser. No. 09/251,453 titled "Graphics System with Programmable Real-Time Sample Filtering" filed Feb. 17, 1999, whose inventors are Michael F. Deering, David Naegle and Scott Nelson.

U.S. patent application Ser. No. 09/970,077 titled "Programmable Sample Filtering For Image Rendering" filed Oct. 3, 2001, whose inventors are Wayne E. Burk, Yan Y. Tang, Michael G. Lavelle, Philip C. Leung, Michael F. Deering and Ranjit S. Oberoi.

U.S. patent application Ser. No. 09/861,479 titled "Sample Cache For Supersample Filtering" filed May 18, 2001, whose inventors are Michael G. Lavelle, Philip C. Leung and Yan Y. Tang Computer System—FIG. 1

FIG. 1 illustrates one embodiment of a computer system 80 that includes a graphics system. The graphics system may be included in any of various systems such as computer systems, network PCs, Internet appliances, televisions (e.g. HDTV systems and interactive television systems), personal digital assistants (PDAs), virtual reality systems, and other devices which display 2D and/or 3D graphics, among others.

As shown, the computer system 80 includes a system unit 82 and a video monitor or display device 84 coupled to the system unit 82. The display device 84 may be any of various types of display monitors or devices (e.g., a CRT, LCD, or gas-plasma display). Various input devices may be connected to the computer system, including a keyboard 86 and/or a mouse 88, or other input device (e.g., a trackball, digitizer, tablet, six-degree of freedom input device, head tracker, eye tracker, data glove, or body sensors). Application software may be executed by the computer system 80 to display graphical objects on display device 84.

Figure 2:
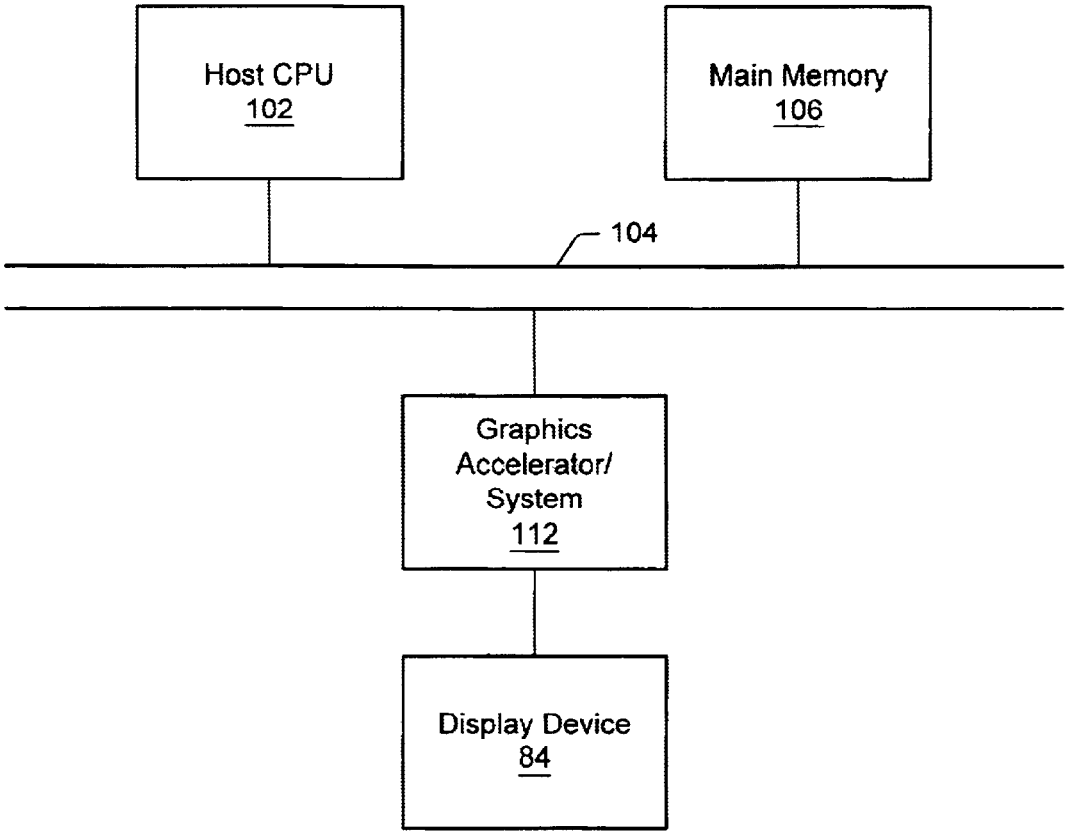
FIG. 2 is a simplified block diagram of one embodiment of a computer system.

Computer System Block Diagram—FIG. 2

FIG. 2 is a simplified block diagram illustrating the computer system of FIG. 1. As shown, the computer system 80 includes a central processing unit (CPU) 102 coupled to a high-speed memory bus or system bus 104 also referred to as the host bus 104. A system memory 106 (also referred to herein as main memory) may also be coupled to high-speed bus 104.

Host processor 102 may include one or more processors of varying types, e.g., microprocessors, multi-processors and CPUs. The system memory 106 may include any combination of different types of memory subsystems such as random access memories (e.g., static random access memories or "SRAMs," synchronous dynamic random access memories or "SDRAMs," and Rambus dynamic random access memories or "RDRAMs," among others), read-only memories, and mass storage devices. The system bus or host bus 104 may include one or more communication or host computer buses (for communication between host processors, CPUs, and memory subsystems) as well as specialized subsystem buses.

In FIG. 2, a graphics system 112 is coupled to the high-speed memory bus 104. The graphics system 112 may be coupled to the bus 104 by, for example, a crossbar switch or other bus connectivity logic. It is assumed that various other peripheral devices, or other buses, may be connected to the high-speed memory bus 104. It is noted that the graphics system 112 may be coupled to one or more of the buses in computer system 80 and/or may be coupled to various types of buses. In addition, the graphics system 112 may be coupled to a communication port and thereby directly receive graphics data from an external source, e.g., the Internet or a network. As shown in the figure, one or more display devices 84 may be connected to the graphics system 112.

Host CPU 102 may transfer information to and from the graphics system 112 according to a programmed input/output (I/O) protocol over host bus 104. Alternately, graphics system 112 may access system memory 106 according to a direct memory access (DMA) protocol or through intelligent bus mastering.

A graphics application program conforming to an application programming interface (API) such as OpenGL® or Java 3D™ may execute on host CPU 102 and generate commands and graphics data that define geometric primitives such as polygons for output on display device 84. Host processor 102 may transfer the graphics data to system memory 106. Thereafter, the host processor 102 may operate to transfer the graphics data to the graphics system 112 over the host bus 104. In another embodiment, the graphics system 112 may read in geometry data arrays over the host bus 104 using DMA access cycles. In yet another embodiment, the graphics system 112 may be coupled to the system memory 106 through a direct port, such as the Advanced Graphics Port (AGP) promulgated by Intel Corporation.

The graphics system may receive graphics data from any of various sources, including host CPU 102 and/or system memory 106, other memory, or from an external source such as a network (e.g. the Internet), or from a broadcast medium, e.g., television, or from other sources.

Note while graphics system 112 is depicted as part of computer system 80, graphics system 112 may also be configured as a stand-alone device (e.g., with its own built-in display). Graphics system 112 may also be configured as a single chip device or as part of a system-on-a-chip or a multi-chip module. Additionally, in some embodiments, certain of the processing operations performed by elements of the illustrated graphics system 112 may be implemented in software.

Figure 3:
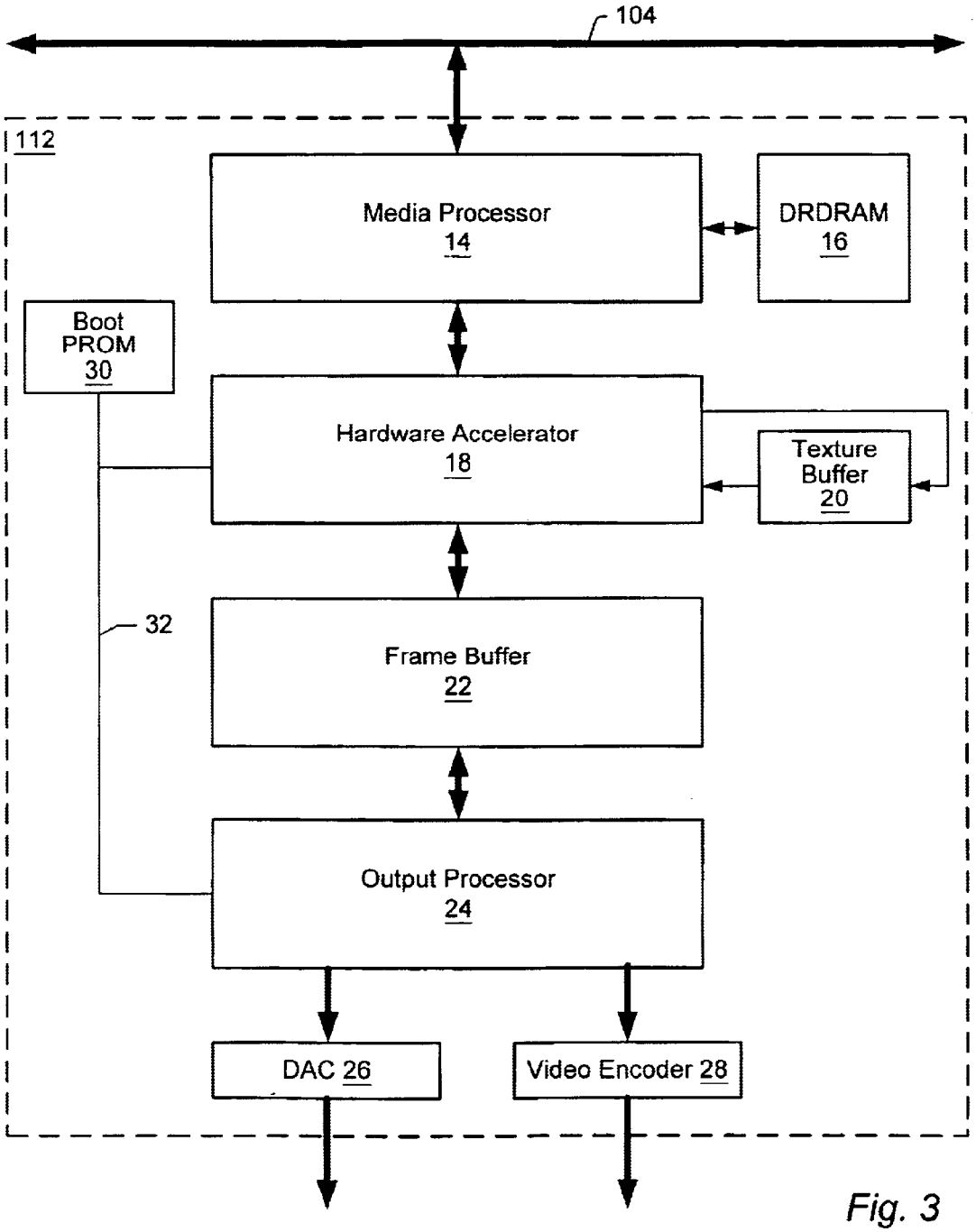
FIG. 3 is a functional block diagram of one embodiment of a graphics system.

Graphics System—FIG. 3

FIG. 3 is a functional block diagram illustrating one embodiment of graphics system 112. Note that many other embodiments of graphics system 112 are possible and contemplated. Graphics system 112 may include one or more media processors 14, one or more hardware accelerators 18, one or more texture buffers 20, one or more frame buffers 22, and one or more video output processors 24. Graphics system 112 may also include one or more output devices such as digital-to-analog converters (DACs) 26, video encoders 28, flat-panel-display drivers (not shown), and/or video projectors (not shown). Media processor 14 and/or hardware accelerator 18 may include any suitable type of high performance processor (e.g., specialized graphics processors or calculation units, multimedia processors, DSPs, or general purpose processors).

In some embodiments, one or more of these components may be removed. For example, the texture buffer may not be included in an embodiment that does not provide texture mapping. In other embodiments, all or part of the functionality incorporated in either or both of the media processor or the hardware accelerator may be implemented in software.

In one set of embodiments, media processor 14 is one integrated circuit and hardware accelerator is another integrated circuit. In other embodiments, media processor 14 and hardware accelerator 18 may be incorporated within the same integrated circuit. In some embodiments, portions of media processor 14 and/or hardware accelerator 18 may be included in separate integrated circuits.

As shown, graphics system 112 may include an interface to a host bus such as host bus 104 in FIG. 2 to enable graphics system 112 to communicate with a host system such as computer system 80. More particularly, host bus 104 may allow a host processor to send commands to the graphics system 112. In one embodiment, host bus 104 may be a bi-directional bus.

Figure 4:
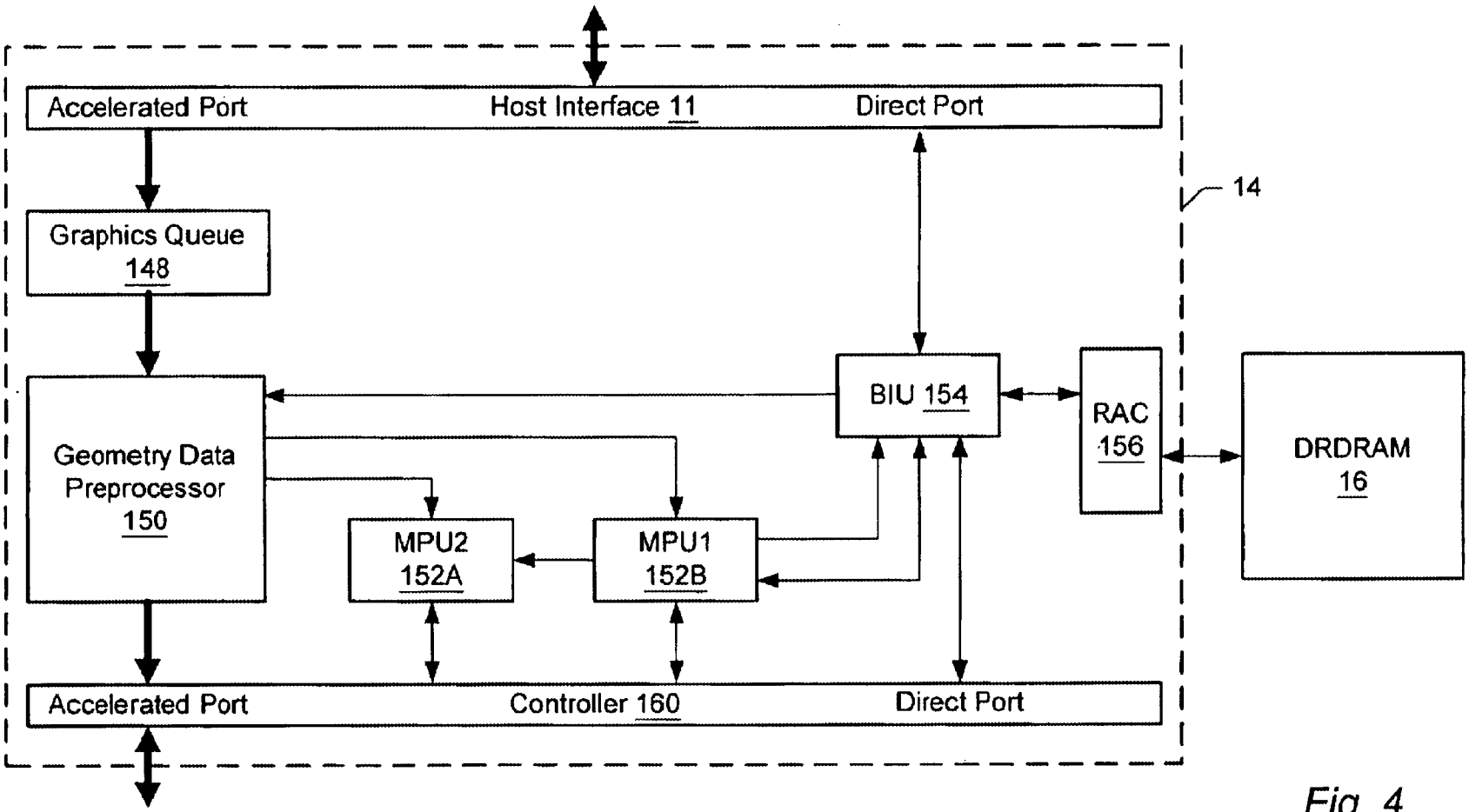
FIG. 4 is a functional block diagram of one embodiment of the media processor of FIG. 3.

Media Processor—FIG. 4

FIG. 4 shows one embodiment of media processor 14. As shown, media processor 14 may operate as the interface between graphics system 112 and computer system 80 by controlling the transfer of data between computer system 80 and graphics system 112. In some embodiments, media processor 14 may also be configured to perform transformations, lighting, and/or other general-purpose processing operations on graphics data.

Transformation refers to the spatial manipulation of objects (or portions of objects) and includes translation, scaling (e.g. stretching or shrinking), rotation, reflection, or combinations thereof. More generally, transformation may include linear mappinga (e.g. matrix multiplications), non-linear mappings, and combinations thereof.

Lighting refers to calculating the illumination of the objects within the displayed image to determine what color values and/or brightness values each individual object will have. Depending upon the shading algorithm being used (e.g., constant, Gourand, or Phong), lighting may be evaluated at a number of different spatial locations.

As illustrated, media processor 14 may be configured to receive graphics data via host interface 11. A graphics queue 148 may be included in media processor 14 to buffer a stream of data received via the accelerated port of host interface 11. The received graphics data may include one or more graphics primitives. As used herein, the term graphics primitive may include polygons, parametric surfaces, splines, NURBS (non-uniform rational B-splines), subdivisions surfaces, fractals, volume primitives, voxels (i.e., three-dimensional pixels), and particle systems. In one embodiment, media processor 14 may also include a geometry data preprocessor 150 and one or more microprocessor units (MPUs) 152. MPUs 152 may be configured to perform vertex transformation, lighting calculations and other programmable functions, and to send the results to hardware accelerator 18. MPUs 152 may also have read/write access to texels (i.e. the smallest addressable unit of a texture map) and pixels in the hardware accelerator 18. Geometry data preprocessor 150 may be configured to decompress geometry, to convert and format vertex data, to dispatch vertices and instructions to the MPUs 152, and to send vertex and attribute tags or register data to hardware accelerator 18.

As shown, media processor 14 may have other possible interfaces, including an interface to one or more memories. For example, as shown, media processor 14 may include direct Rambus interface 156 to a direct Rambus DRAM (DRDRAM) 16. A memory such as DRDRAM 16 may be used for program and/or data storage for MPUs 152. DRDRAM 16 may also be used to store display lists and/or vertex texture maps.

Media processor 14 may also include interfaces to other functional components of graphics system 112. For example, media processor 14 may have an interface to another specialized processor such as hardware accelerator 18. In the illustrated embodiment, controller 160 includes an accelerated port path that allows media processor 14 to control hardware accelerator 18. Media processor 14 may also include a direct interface such as bus interface unit (BIU) 154. Bus interface unit 154 provides a path to memory 16 and a path to hardware accelerator 18 and video output processor 24 via controller 160.

Figure 5:
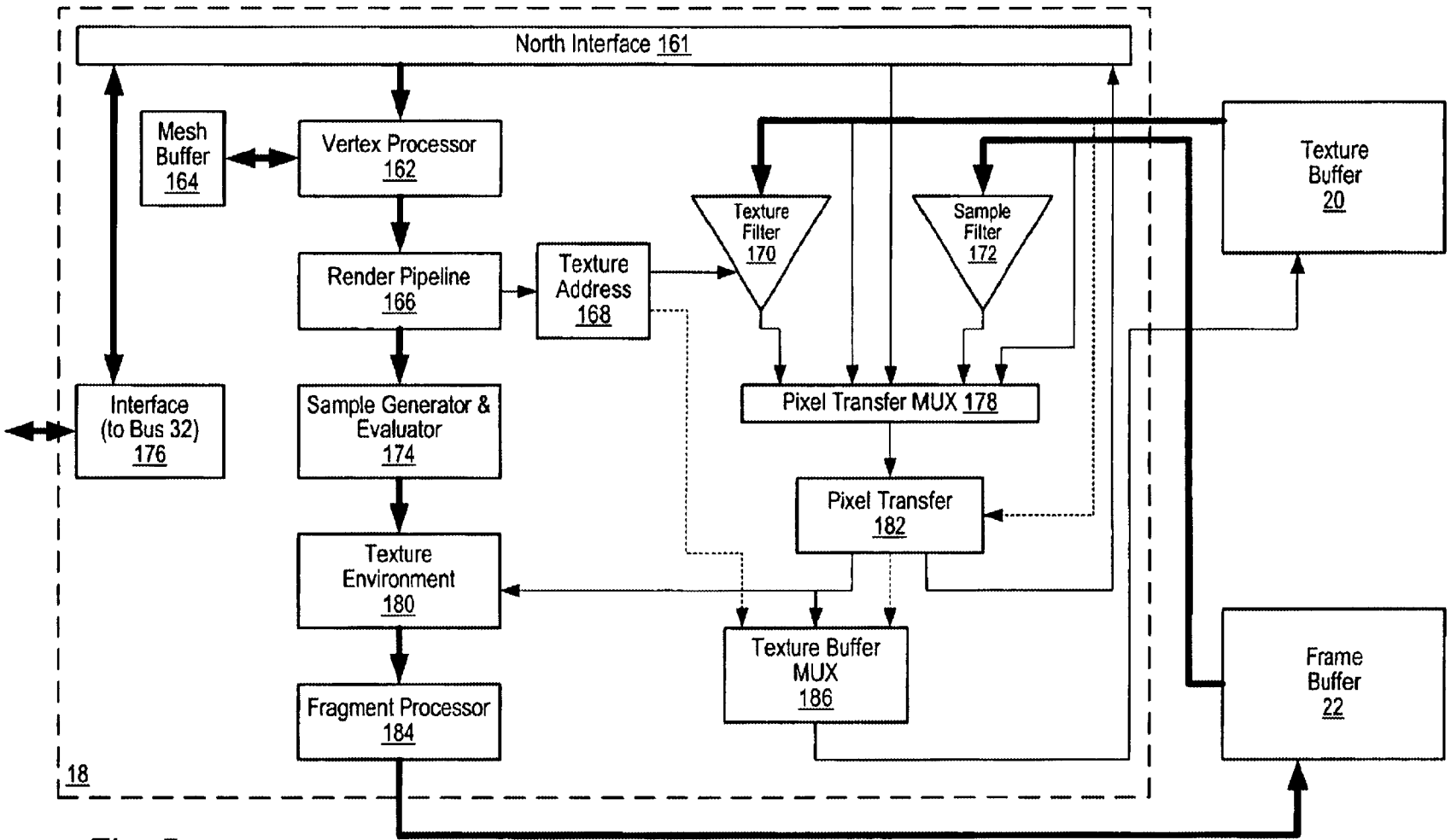
FIG. 5 is a functional block diagram of one embodiment of the hardware accelerator of FIG. 3.

Hardware Accelerator—FIG. 5

One or more hardware accelerators 18 may be configured to receive graphics instructions and data from media processor 14 and to perform a number of functions on the received data according to the received instructions. For example, hardware accelerator 18 may be configured to perform rasterization, 2D and/or 3D texturing, pixel transfers, imaging, fragment processing, clipping, depth cueing, transparency processing, set-up, and/or screen space rendering of various graphics primitives occurring within the graphics data.

Clipping refers to the elimination of graphics primitives or portions of graphics primitives that lie outside of a 3D view volume in world space. The 3D view volume may represent that portion of world space that is visible to a virtual observer (or virtual camera) situated in world space. For example, the view volume may be a solid truncated pyramid generated by a 2D view window, a viewpoint located in world space, a front clipping plane and a back clipping plane. The viewpoint may represent the world space location of the virtual observer. In most cases, primitives or portions of primitives that lie outside the 3D view volume are not currently visible and may be eliminated from further processing. Primitives or portions of primitives that lie inside the 3D view volume are candidates for projection onto the 2D view window.

Set-up refers to mapping primitives to a three-dimensional viewport. This involves translating and transforming the objects from their original "world-coordinate" system to the established viewport's coordinates. This creates the correct perspective for three-dimensional objects displayed on the screen.

Screen-space rendering refers to the calculations performed to generate the data used to form each pixel that will be displayed. For example, hardware accelerator 18 may calculate "samples." Samples are points that have color information but no real area. Samples allow hardware accelerator 18 to "super-sample," or calculate more than one sample per pixel. Super-sampling may result in a higher quality image.

Hardware accelerator 18 may also include several interfaces. For example, in the illustrated embodiment, hardware accelerator 18 has four interfaces. Hardware accelerator 18 has an interface 161 (referred to as the "North Interface") to communicate with media processor 14. Hardware accelerator 18 may receive commands and/or data from media processor 14 through interface 161. Additionally, hardware accelerator 18 may include an interface 176 to bus 32. Bus 32 may connect hardware accelerator 18 to boot PROM 30 and/or video output processor 24. Boot PROM 30 may be configured to store system initialization data and/or control code for frame buffer 22. Hardware accelerator 18 may also include an interface to a texture buffer 20. For example, hardware accelerator 18 may interface to texture buffer 20 using an eight-way interleaved texel bus that allows hardware accelerator 18 to read from and write to texture buffer 20. Hardware accelerator 18 may also interface to a frame buffer 22. For example, hardware accelerator 18 may be configured to read from and/or write to frame buffer 22 using a four-way interleaved pixel bus.

The vertex processor 162 may be configured to use the vertex tags received from the media processor 14 to perform ordered assembly of the vertex data from the MPUs 152. Vertices may be saved in and/or retrieved from a mesh buffer 164.

The render pipeline 166 may be configured to rasterize 2D window system primitives and 3D primitives into fragments. A fragment may contain one or more samples. Each sample may contain a vector of color data and perhaps other data such as alpha and control tags. 2D primitives include objects such as dots, fonts, Bresenham lines and 2D polygons. 3D primitives include objects such as smooth and large dots, smooth and wide DDA (Digital Differential Analyzer) lines and 3D polygons (e.g. 3D triangles).

For example, the render pipeline 166 may be configured to receive vertices defining a triangle, to identify fragments that intersect the triangle.

The render pipeline 166 may be configured to handle full-screen size primitives, to calculate plane and edge slopes, and to interpolate data (such as color) down to tile resolution (or fragment resolution) using interpolants or components such as:

r, g, b (i.e., red, green, and blue vertex color);

r2, g2, b2 (i.e., red, green, and blue specular color from lit textures);

alpha (i.e. transparency);

z (i.e. depth); and s, t, r, and w (i.e. texture components).

In embodiments using supersampling, the sample generator 174 may be configured to generate samples from the fragments output by the render pipeline 166 and to determine which samples are inside the rasterization edge. Sample positions may be defined by user-loadable tables to enable various types of sample-positioning patterns.

Hardware accelerator 18 may be configured to write textured fragments from 3D primitives to frame buffer 22. The render pipeline 166 may send pixel tiles defining r, s, t and w to the texture address unit 168. The texture address unit 168 may determine the set of neighboring texels that are addressed by the fragment(s), as well as the interpolation coefficients for the texture filter, and write texels to the texture buffer 20. The texture buffer 20 may be interleaved to obtain as many neighboring texels as possible in each clock. The texture filter 170 may perform bilinear, trilinear or quadlinear interpolation. The pixel transfer unit 182 may also scale and bias and/or lookup texels. The texture environment 180 may apply texels to samples produced by the sample generator 174. The texture environment 180 may also be used to perform geometric transformations on images (e.g., bilinear scale, rotate, flip) as well as to perform other image filtering operations on texture buffer image data (e.g., bicubic scale and convolutions).

In the illustrated embodiment, the pixel transfer MUX 178 controls the input to the pixel transfer unit 182. The pixel transfer unit 182 may selectively unpack pixel data received via north interface 161, select channels from either the frame buffer 22 or the texture buffer 20, or select data received from the texture filter 170 or sample filter 172.

The pixel transfer unit 182 may be used to perform scale, bias, and/or color matrix operations, color lookup operations, histogram operations, accumulation operations, normalization operations, and/or min/max functions. Depending on the source of (and operations performed on) the processed data, the pixel transfer unit 182 may output the processed data to the texture buffer 20 (via the texture buffer MUX 186), the frame buffer 22 (via the texture environment unit 180 and the fragment processor 184), or to the host (via north interface 161). For example, in one embodiment, when the pixel transfer unit 182 receives pixel data from the host via the pixel transfer MUX 178, the pixel transfer unit 182 may be used to perform a scale and bias or color matrix operation, followed by a color lookup or histogram operation, followed by a min/max function. The pixel transfer unit 182 may then output data to either the texture buffer 20 or the frame buffer 22.

Fragment processor 184 may be used to perform standard fragment processing operations such as the OpenGL® fragment processing operations. For example, the fragment processor 184 may be configured to perform the following operations: fog, area pattern, scissor, alpha/color test, ownership test (WID), stencil test, depth test, alpha blends or logic ops (ROP), plane masking, buffer selection, pick hit/occlusion detection, and/or auxiliary clipping in order to accelerate overlapping windows.

Texture Buffer 20

Texture buffer 20 may include several SDRAMs. Texture buffer 20 may be configured to store texture maps, image processing buffers, and accumulation buffers for hardware accelerator 18. Texture buffer 20 may have many different capacities (e.g., depending on the type of SDRAM included in texture buffer 20). In some embodiments, each pair of SDRAMs may be independently row and column addressable.

Frame Buffer 22

Graphics system 112 may also include a frame buffer 22. In one embodiment, frame buffer 22 may include multiple 3D-RAM memory devices (e.g. 3D-RAM64 memory devices) manufactured by Mitsubishi Electric Corporation. Frame buffer 22 may be configured as a display pixel buffer, an offscreen pixel buffer, and/or a super-sample buffer. Furthermore, in one embodiment, certain portions of frame buffer 22 may be used as a display pixel buffer, while other portions may be used as an offscreen pixel buffer and sample buffer. In one embodiment, graphics system 112 may include a sample buffer for storing samples, and may not include a frame buffer 22 for storing pixels. Rather, the graphics system 112 may be operable to access and filter samples and provide resulting pixels to a display with no frame buffer. Thus, in this embodiment the samples are filtered and pixels generated and provided to the display "on the fly" with no storage of the pixels.

Figure 6:
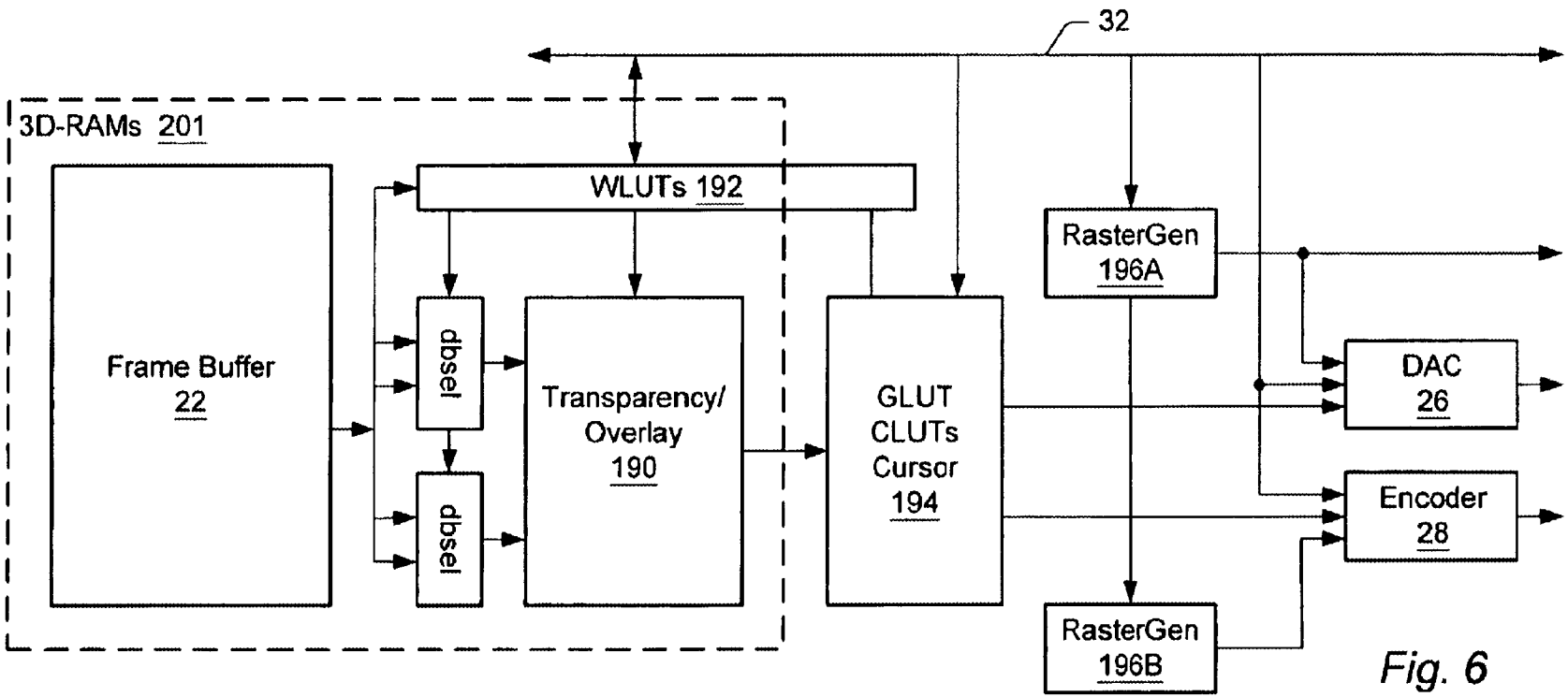
FIG. 6 is a functional block diagram of one embodiment of the video output processor of FIG. 3.

Video Output Processor—FIG. 6

A video output processor 24 may also be included within graphics system 112. Video output processor 24 may buffer and process pixels output from frame buffer 22. For example, video output processor 24 may be configured to read bursts of pixels from frame buffer 22. Video output processor 24 may also be configured to perform double buffer selection (dbsel) if the frame buffer 22 is double-buffered, overlay transparency (using transparency/overlay unit 190), plane group extraction, gamma correction, psuedocolor or color lookup or bypass, and/or cursor generation. For example, in the illustrated embodiment, the output processor 24 includes WID (Window ID) lookup tables (WLUTs) 192 and gamma and color map lookup tables (GLUTs, CLUTs) 194. In one embodiment, frame buffer 22 may include multiple 3DRAM64s 201 that include the transparency overlay 190 and all or some of the WLUTs 192. Video output processor 24 may also be configured to support two video output streams to two displays using the two independent video raster timing generators 196. For example, one raster (e.g., 196A) may drive a 1280×1024 CRT while the other (e.g., 196B) may drive a NTSC or PAL device with encoded television video.

DAC 26 may operate as the final output stage of graphics system 112. The DAC 26 translates the digital pixel data received from GLUT/CLUTs/Cursor unit 194 into analog video signals that are then sent to a display device. In one embodiment, DAC 26 may be bypassed or omitted completely in order to output digital pixel data in lieu of analog video signals. This may be useful when a display device is based on a digital technology (e.g., an LCD-type display or a digital micro-mirror display).

DAC 26 may be a red-green-blue digital-to-analog converter configured to provide an analog video output to a display device such as a cathode ray tube (CRT) monitor. In one embodiment, DAC 26 may be configured to provide a high resolution RGB analog video output at dot rates of 240 MHz. Similarly, encoder 28 may be configured to supply an encoded video signal to a display. For example, encoder 28 may provide encoded NTSC or PAL video to an S-Video or composite video television monitor or recording device.

In other embodiments, the video output processor 24 may output pixel data to other combinations of displays. For example, by outputting pixel data to two DACs 26 (instead of one DAC 26 and one encoder 28), video output processor 24 may drive two CRTs. Alternately, by using two encoders 28, video output processor 24 may supply appropriate video input to two television monitors. Generally, many different combinations of display devices may be supported by supplying the proper output device and/or converter for that display device.

Sample-to-Pixel Processing

Figure 7:
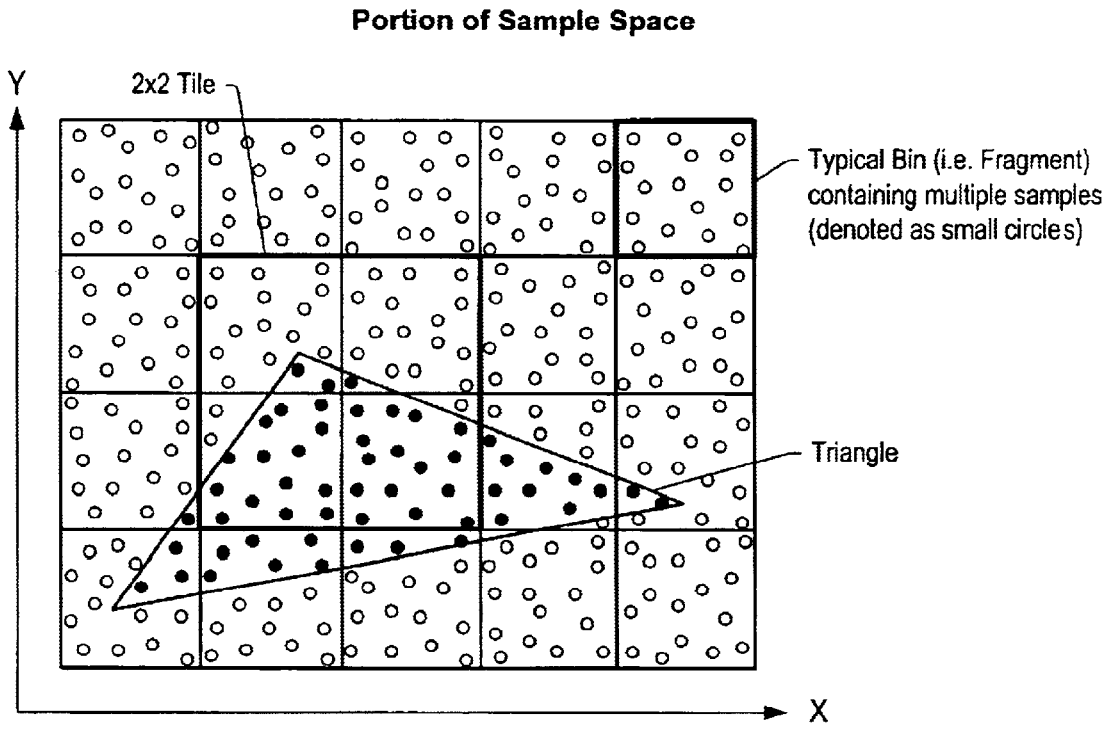
FIG. 7 illustrates the manner in which samples are considered for generating pixels in a polygon (e.g., a triangle)

In one set of embodiments, hardware accelerator 18 may receive geometric parameters defining primitives such as triangles from media processor 14, and render the primitives in terms of samples. The samples may be stored in a sample storage area (also referred to as the sample buffer) of frame buffer 22. The samples may be computed at positions in a two-dimensional sample space (also referred to as rendering space). The sample space may be partitioned into an array of bins (also referred to herein as fragments). The storage of samples in the sample storage area of frame buffer 22 may be organized according to bins (e.g. bin 300) as illustrated in FIG. 7. Each bin may contain one or more samples. The number of samples per bin may be a programmable parameter.

The samples may then be read from the sample storage area of frame buffer 22 and filtered by sample filter 22 to generate pixels. In one embodiment, the pixels may be stored in a pixel storage area of frame buffer 22. The pixel storage area may be double-buffered. Video output processor 24 reads the pixels from the pixel storage area of frame buffer 22 and generates a video stream from the pixels. The video stream may be provided to one or more display devices (e.g. monitors, projectors, head-mounted displays, and so forth) through DAC 26 and/or video encoder 28. In one embodiment, as discussed above, the sample filter 22 may filter respective samples to generate pixels, and the pixels may be provided as a video stream to the display without any intervening frame buffer storage, i.e., without storage of the pixels.

Figure 8:
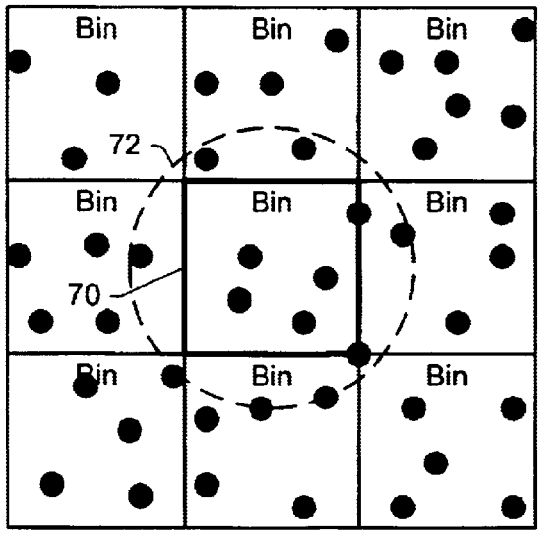
FIG. 8 illustrates a filter support region centered on a bin used to generate a pixel from samples contained within the support region.

Super-Sampling Sample Positions—FIG. 8

FIG. 8 illustrates a portion of rendering space in a super-sampled mode of operation. The dots denote sample locations. The rectangular boxes superimposed on the rendering space are referred to as bins. A rendering unit (e.g. rendering unit 166) may generate a plurality of samples in each bin (e.g. at the center of each bin). Values of red, green, blue, z, etc. are computed for each sample.

The sample filter 172 may be programmed to generate one pixel position in each bin (e.g. at the center of each bin). For example, if the bins are squares with side length one, the horizontal and vertical step sizes between successive pixel positions may be set equal to one.

Each pixel may be computed on the basis of one or more samples. For example, the pixel located in bin 70 may simply take the values of samples in the same bin. Alternatively, the pixel located in bin 70 may be computed on the basis of filtering samples in a support region (or extent) covering multiple bins including bin 70.

FIG. 8 illustrates an example of one embodiment of super-sampling. In this embodiment, a plurality of samples are computed per bin. The samples may be positioned according to various sample position schemes. In the embodiment of FIG. 8, the samples are positioned randomly. Thus, the number of samples falling within the filter support region may vary from pixel to pixel. Render unit 166 calculates color information at each sample position. In another embodiment, the samples may be distributed according to a regular grid. The sample filter 172 may operate to generate one pixel position at the center of each bin. (Again, the horizontal and vertical pixel step sizes may be set to one.)

The pixel at the center of bin 70 may be computed on the basis of a plurality of samples falling in support region 72. The radius of the support region may be programmable. As the radius increases, the support region 72 would cover a greater number of samples, possibly including those from neighboring bins.

The sample filter 172 may compute each pixel by operating on samples with a filter. Support region 72 illustrates the support of a filter which is localized at the center of bin 70. The support of a filter is the set of locations over which the filter (i.e. the filter kernel) is defined. In this example, the support region 72 is a circular disc. The output pixel values (e.g. red, green, blue) for the pixel at the center of bin 70 are determined by samples which fall within support region 72. This filtering operation may advantageously improve the realism of a displayed image by smoothing abrupt edges in the displayed image (i.e., by performing anti-aliasing). The filtering operation may simply average the values of samples within the support region 72 to form the corresponding output values of pixel 70. More generally, the filtering operation may generate a weighted sum of the values of samples within the support region 72, where the contribution of each sample may be weighted according to some function of the sample's position (or distance) with respect to the center of support region 72.

The filter, and thus support region 72, may be repositioned for each output pixel being calculated. For example, the filter center may visit the center of each bin. It is noted that the filters for neighboring pixels may have one or more samples in common in both the x and y directions. One embodiment of the present invention comprises a method for accessing samples from a memory in an efficient manner during pixel calculation to reduce the number of memory accesses. More specifically, one embodiment of the present invention comprises a method for accessing samples from a memory for pixels being generated in multiple neighboring or adjacent scan lines.

Figure 9:
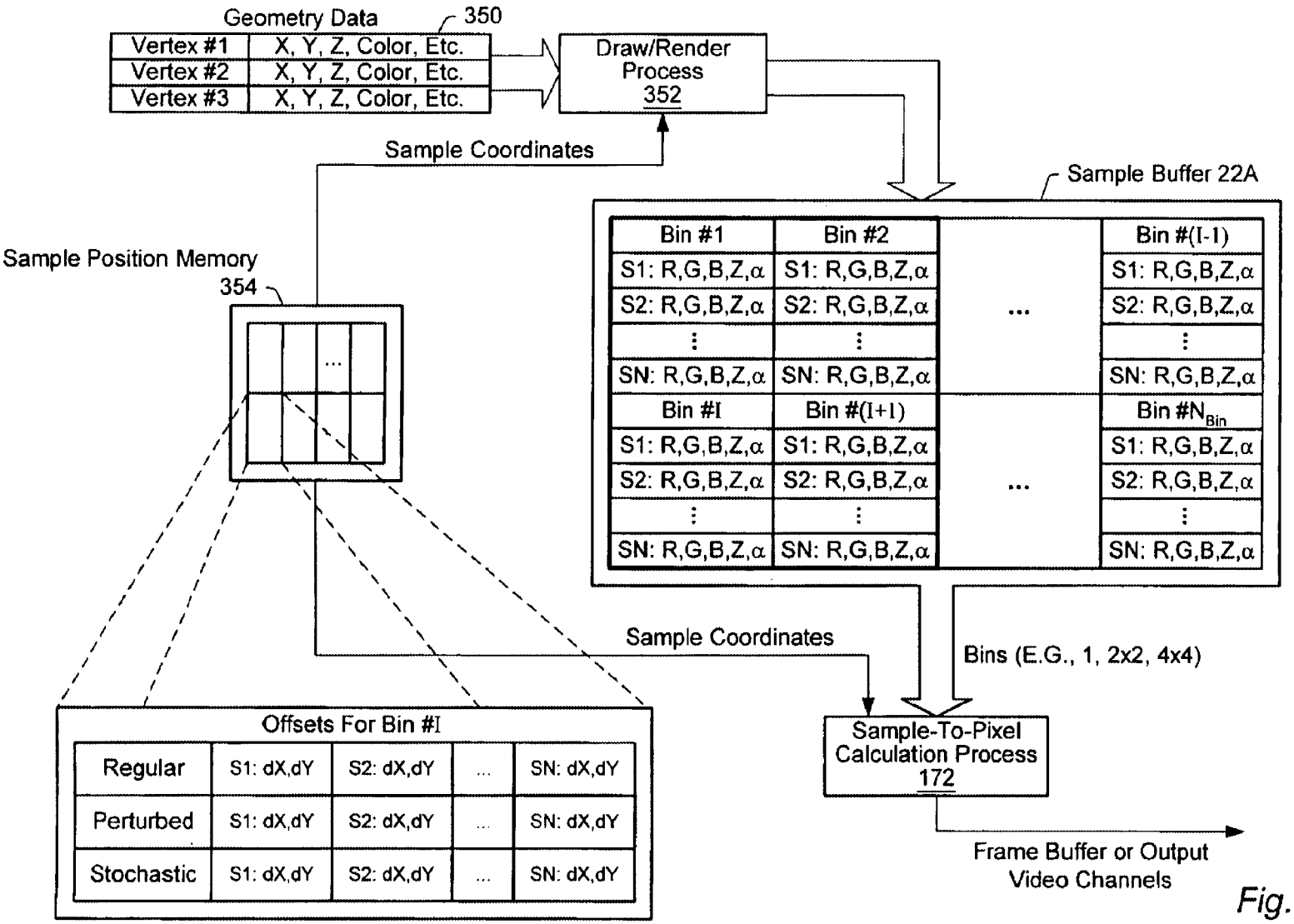
FIG. 9 illustrates details of one embodiment of a graphics system having a super-sampled sample buffer.
Figure 10A:
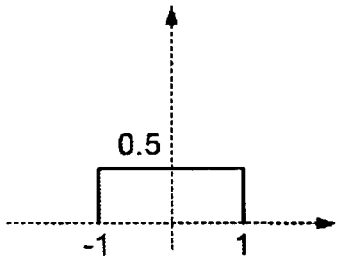
FIGS. 10A–10D illustrate use of a box filter.
Figure 10B:
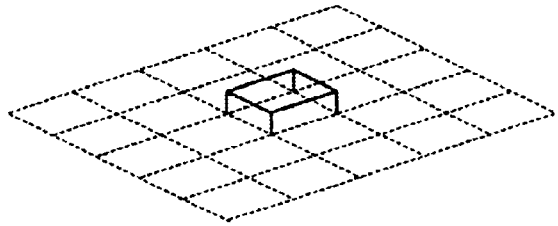
Figure 10C:
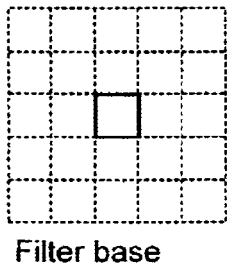
Figure 10D:
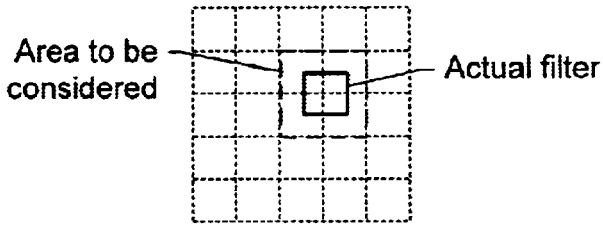

FIG. 9—Sample-to-Pixel Processing Flow—Pixel Generation From Samples

FIG. 9 illustrates one possible configuration for the flow of data through one embodiment of graphics system 112. As FIG. 9 shows, geometry data 350 is received by graphics system 112 and used to perform draw/render process 352. The draw process 352 may be implemented by one or more of the vertex processor 162, render pipeline 166, sample generator & evaluator 174, texture environment 180, and fragment processor 184. Other elements, such as control units, rendering units, memories, and schedule units may also be involved in the draw/render process 352. Geometry data 350 comprises data for one or more polygons. Each polygon comprises a plurality of vertices (e.g., three vertices in the case of a triangle). Some of the vertices may be shared between multiple polygons. Data such as x, y, and z coordinates, color data, lighting data and texture map information may be included for each vertex.

In addition to the vertex data, draw process 352 also receives sample coordinates from a sample position memory 354. In one embodiment, position memory 354 is embodied within sample generator & evaluator 174. Sample position memory 354 is configured to store position information for samples that are calculated in draw process 352 and then stored into super-sampled sample buffer 22A. The super-sampled sample buffer 22A may be a part of frame buffer 22 in the embodiment of FIG. 5. In one embodiment, position memory 354 may be configured to store entire sample addresses. Alternatively, position memory 354 may be configured to store only x- and y-offsets for the samples. Storing only the offsets may use less storage space than storing each sample's entire position. The offsets may be relative to bin coordinates or relative to positions on a regular grid. The sample position information stored in sample position memory 354 may be read by a dedicated sample position calculation unit (not shown) and processed to calculate sample positions for graphics processor 90.

Sample-to-pixel calculation process (or sample filter) 172 may use the same sample positions as draw process 352. Thus, in one embodiment, sample position memory 354 may generate sample positions for draw process 352, and may subsequently regenerate the same sample positions for sample-to-pixel calculation process 172.

As shown in the embodiment of FIG. 9, sample position memory 354 may be configured to store sample offsets dX and dY generated according to a number of different schemes such as a regular square grid, a regular hexagonal grid, a perturbed regular grid, or a random (stochastic) distribution. Graphics system 112 may receive an indication from the host application or the graphics API that indicates which type of sample positioning scheme is to be used. Thus the sample position memory 354 may be configurable or programmable to generate position information according to one or more different schemes.

In one embodiment, sample position memory 354 may comprise a RAM/ROM that contains stochastically determined sample points or sample offsets. Thus, the density of samples in the rendering space may not be uniform when observed at small scale. As used herein, the term "bin" refers to a region or area in virtual screen space.

An array of bins may be superimposed over the rendering space, i.e. the 2-D viewport, and the storage of samples in sample buffer 22A may be organized in terms of bins. Sample buffer 22A may comprise an array of memory blocks which correspond to the bins. Each memory block may store the sample values (e.g. red, green, blue, z, alpha, etc.) for the samples that fall within the corresponding bin. The approximate location of a sample is given by the bin in which it resides. The memory blocks may have addresses which are easily computable from the corresponding bin locations in virtual screen space, and vice versa. Thus, the use of bins may simplify the storage and access of sample values in sample buffer 22A.

The bins may tile the 2-D viewport in a regular array, e.g. in a square array, rectangular array, triangular array, hexagonal array, etc., or in an irregular array. Bins may occur in a variety of sizes and shapes. The sizes and shapes may be programmable. The maximum number of samples that may populate a bin is determined by the storage space allocated to the corresponding memory block. This maximum number of samples per bin is referred to herein as the bin sample capacity, or simply, the bin capacity. The bin capacity may take any of a variety of values. The bin capacity value may be programmable. Henceforth, the memory blocks in sample buffer 22A which correspond to the bins in rendering space will be referred to as memory bins.

The specific position of each sample within a bin may be determined by looking up the sample's offset in the RAM/ROM table, i.e., the sample's offset with respect to the bin position (e.g. the lower-left corner or center of the bin, etc.). However, depending upon the implementation, not all choices for the bin capacity may have a unique set of offsets stored in the RAM/ROM table. Offsets for a first bin capacity value may be determined by accessing a subset of the offsets stored for a second larger bin capacity value. In one embodiment, each bin capacity value supports at least four different sample positioning schemes. The use of different sample positioning schemes may reduce final image artifacts that would arise in a scheme of naively repeating sample positions.

In one embodiment, sample position memory 354 may store pairs of 8-bit numbers, each pair comprising an x-offset and a y-offset. When added to a bin position, each pair defines a particular position in rendering space. To improve read access times, sample position memory 354 may be constructed in a wide/parallel manner so as to allow the memory to output more than one sample location per read cycle.

Once the sample positions have been read from sample position memory 354, draw process 352 selects the samples that fall within the polygon currently being rendered. This is illustrated in FIG. 7. Draw process 352 then may calculate depth (z), color information, and perhaps other sample attributes (which may include alpha and/or a depth of field parameter) for each of these samples and store the data into sample buffer 22A. In one embodiment, sample buffer 22A may only single-buffer z values (and perhaps alpha values) while double-buffering other sample components such as color. Graphics system 112 may optionally use double-buffering for all samples (although not all components of samples may be double-buffered, i.e., the samples may have some components that are not double-buffered).

The filter process 172 may operate in parallel with draw process 352. The filter process 172 may be configured to:

(a) read sample values from sample buffer 22A, (b) read corresponding sample positions from sample position memory 354, (c) filter the sample values based on their positions (or distance) with respect to the pixel center (i.e. the filter center), (d) output the resulting output pixel values to a frame buffer, or directly onto video channels.

Sample-to-pixel calculation unit or sample filter 172 implements the filter process. Filter process 172 may be operable to generate the red, green, and blue values for an output pixel based on a spatial filtering of the corresponding data for a selected plurality of samples, e.g. samples falling in a filter support region around the current pixel center in the rendering space. Other values such as alpha may also be generated.

In one embodiment, filter process 172 is configured to:

(i) determine the distance of each sample from the pixel center;

(ii) multiply each sample's attribute values (e.g., red, green, blue, alpha) by a filter weight that is a specific programmable) function of the sample's distance (or square distance) from the pixel center;

(iii) generate sums of the weighted attribute values, one sum per attribute (e.g. a sum for red, a sum for green, . . . ), and (iv) normalize the sums to generate the corresponding pixel attribute values.

In the embodiment just described, the filter kernel is a function of distance from the pixel center. However, in alternative embodiments, the filter kernel may be a more general function of X and Y sample displacements from the pixel center, or a function of some non-Euclidean distance from the pixel center. Also, the support of the filter, i.e. the 2-D neighborhood over which the filter kernel is defined, need not be a circular disk. Rather the filter support region may take various shapes.

As described further below, in one embodiment the filter process 172 may be configured to read sample values from the sample buffer 22A corresponding to pixels in multiple neighboring or adjacent scan lines. The filter process 172 may also read corresponding sample positions from sample position memory 354 for each of the read samples. The filter process 172 may filter the sample values based on their positions (or distance) with respect to the pixel center (i.e. the filter center) for pixels in multiple scan lines. Thus, for example, the filter process 172 may generate pixels in pairs in the x direction, wherein the pixel pairs comprise pixels with the same x coordinates and residing in neighboring scan lines.

Thus, one embodiment of the invention comprises a system and method for generating pixels. The system may include a sample buffer 22A for storing a plurality samples in a memory, a sample cache 402 (FIG. 19) for caching recently accessed samples, and a sample filter unit 172 for filtering one or more samples to generate a pixel. The generated pixels may then be stored in a frame buffer or provided to a display device. The method operates to take advantage of the common samples shared by neighboring pixels in both the x and y directions for reduced sample buffer accesses and improved performance.

The method may involve reading a first portion of samples from the memory. The first portion of samples may correspond to pixels in a plurality of (at least two) neighboring scan lines. The first portion of samples may be stored in the cache memory 402 and then accessed from the cache memory 402 for filtering.

The sample filter unit 172 may then access samples from the cache to generate first and second pixels (e.g., two or more pixels) having the same x coordinates, and residing in neighboring or adjacent scan lines. The sample filter unit 172 may operate to filter a first subset of the first portion of samples to generate a first pixel in a first scan line. The sample filter unit 172 may also filter a second subset of the first portion of samples to generate a second pixel in a second scan line, wherein the second scan line neighbors the first scan line. The first subset of the first portion of samples may include a plurality of common samples with the second subset of the first portion of samples. Thus the method may operate to reduce the number of accesses required to be made to the sample buffer 22A. Where the sample filter unit 172 is configured to access samples for greater than 2 neighboring scan lines, the sample filter unit 172 may also obtain these samples during the read performed above, access the requisite samples from the cache 402 and filter other subsets of the first portion of samples to generate additional pixels in other adjacent scan lines.

The sample filter unit 172 may also be operable to generate additional pixels neighboring the first and second pixels in the x direction (in the first and second scan lines) based on the read. In other words, the sample filter unit 172 may also be operable to generate additional pixels having different x coordinates than the first and second pixels, wherein the additional pixels neighbor the first and second pixels in the x direction. In this case, the sample filter unit 172 may access a third subset of the first portion of samples from the cache memory 402 and filter the third subset of samples to generate a third pixel in the first scan line, wherein the third pixel neighbors the first pixel in the first scan line. The sample filter unit 172 may access a fourth subset of the first portion of samples from the cache memory 402 and filter the fourth subset of samples to generate a fourth pixel in the second scan line, wherein the fourth pixel neighbors the second pixel in the second scan line.

The above operation may then be repeated for multiple sets of pixels in the plurality of scan lines, e.g., to generate all pixels in the first and second scan lines. For example, the method may then involve reading a second portion of samples from the sample memory 22A into the cache 402, wherein the second portion of samples corresponds to pixels in the at least two neighboring scan lines, and wherein the second portion of samples neighbors the first portion of samples. The sample filter unit 172 may filter a first subset of the second portion of samples to generate a third pixel in the first scan line, and may filter a second subset of the second portion of samples to generate a fourth pixel in the second scan line. The third pixel may neighbor the first pixel in the first scan line, and the fourth pixel may neighbor the second pixel in the second scan line. In other words, if the first and second pixels have x coordinate A, the third ad fourth pixels have x coordinates A+1. The first subset of the second portion of samples may include a plurality of common samples with the first subset of the first portion of samples, and the second subset of the second portion of samples may include a plurality of common samples with the second subset of the first portion of samples.

The above operation may then be repeated for all of the scan lines in the image being rendered. Thus the sample filter unit 172 may proceed by generating pixels in multiple neighboring scan lines, e.g., generating a pair of pixels in neighboring scan lines having the same x coordinates, and proceeding in this manner in the x direction, one pair at a time until the end of the multiple neighboring scan lines is reached. The method may then operate again on a next set of multiple scan lines, and so on, until all pixels have been rendered. This operates to more efficiently use the sample memory accesses in the generation of pixels.

The description of FIGS. 10–37 further illustrates one embodiment of the invention.

Sample Filtering

As described above, the graphic system may implement super-sampling. The implementation of super-sampling includes a method for filtering the samples into pixels as described above. In one embodiment, each sample that falls into the filter's area or support region has a weight associated with it. Each sample is multiplied by its corresponding weight and added together. This sum is then divided by the sum of the weights to produce the final pixel color. For example, the following filter equation may be used.

$$\frac{1}{\Sigma weight_i}\Sigma(weight_i \times sample_i)$$

Exemplary filters that may be used in various embodiments include a square filter, a cone filter, a Gaussian filter, and a sinc filter. As described above, a filter can include several bins in its calculation to determine the color of a single pixel. A bin may be a 1×1 pixel in size and in one embodiment can hold up to 16 samples.

Filter diameters may be as follows:

| Filter | Maximum Footprint Diameter (in bins) |
|---|---|
| Square | 1 |
| Cone | 2 |
| Gaussian | 3 |
| Sinc | 4 |

The filter may be centered on the pixel in question, and all samples which are within the filter's diameter or support region may contribute to the pixel. Each sample may be weighted according to the filter function. In normal super-sampling mode, the filter moves in one bin increments in the x direction over a scan line. However, during zoom-in the filter moves in fractional increments and during zoom-out the filter moves in greater than one decimal increments. The filter may be implemented with a lookup table. The samples may be listed in order of quality. As the quality of the filter increases, the computation cost increases as well.

FIGS. 10A–10D illustrate use of a box filter. A box filter is a simple "average" filter. Each sample inside the filter is weighted equally with a weight of 1/n where n is the number of samples per bin. The samples are simply averaged together to find the value of the pixel. The box filter may consider samples within a 2×2 bin area. Even though the diameter is 2, the pixel center may be offset due to zoom and could have samples in 4 different bins.

Figure 11A:
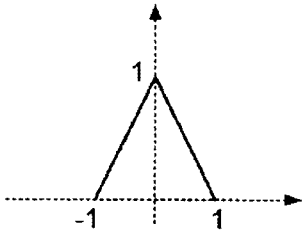
FIGS. 11A–11C illustrate use of a cone filter.
Figure 11B:
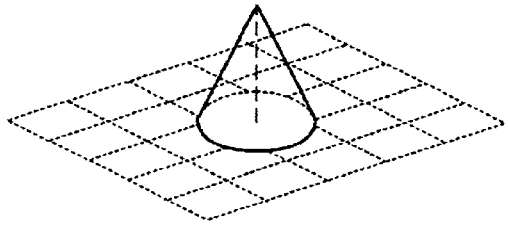
Figure 11C:
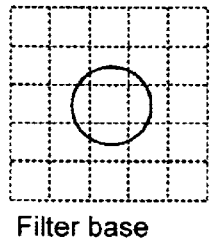

FIGS. 11A–11C illustrate use of a cone filter. The cone filter is the 3D equivalent to the tent filter in 2D. The weight of each sample may be determined by a linear function dependent on its distance from the center. The function may increase linearly towards the center of the bin. The filter may consider samples within a 3×3 bin area.

Figure 12A:
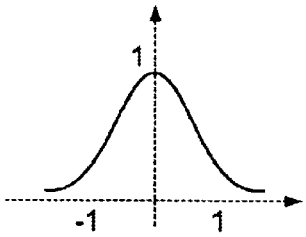
FIGS. 12A–12C illustrate use of a Gaussian filter.
Figure 12B:
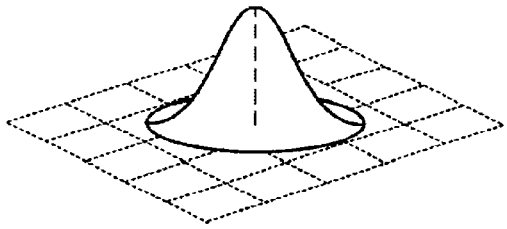
Figure 12C:
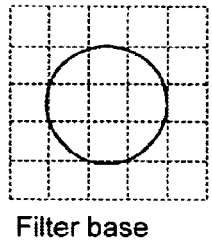

FIGS. 12A–12C illustrate use of a Gaussian filter. The Gaussian filter provides a smooth curve to weight the samples. The filter may consider samples within a 4×4 bin area.

Figure 13A:
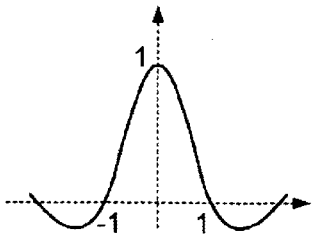
FIGS. 13A–13C illustrate use of a Sinc filter.
Figure 13B:
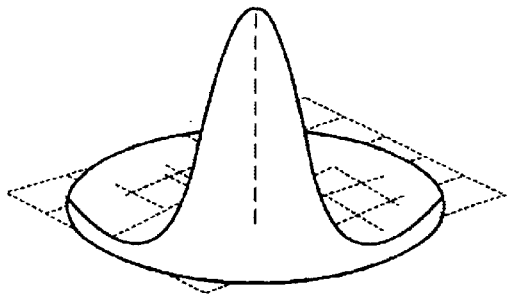
Figure 13C:
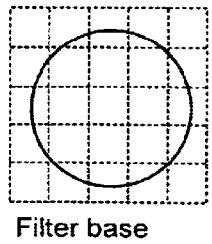

FIGS. 13A–13C illustrate use of a Sinc filter. The Sinc filter may provide the highest quality filtering (at the highest cost). In one embodiment, the Sinc filter may consider all samples within a 5×5 bin area.

Figure 14:
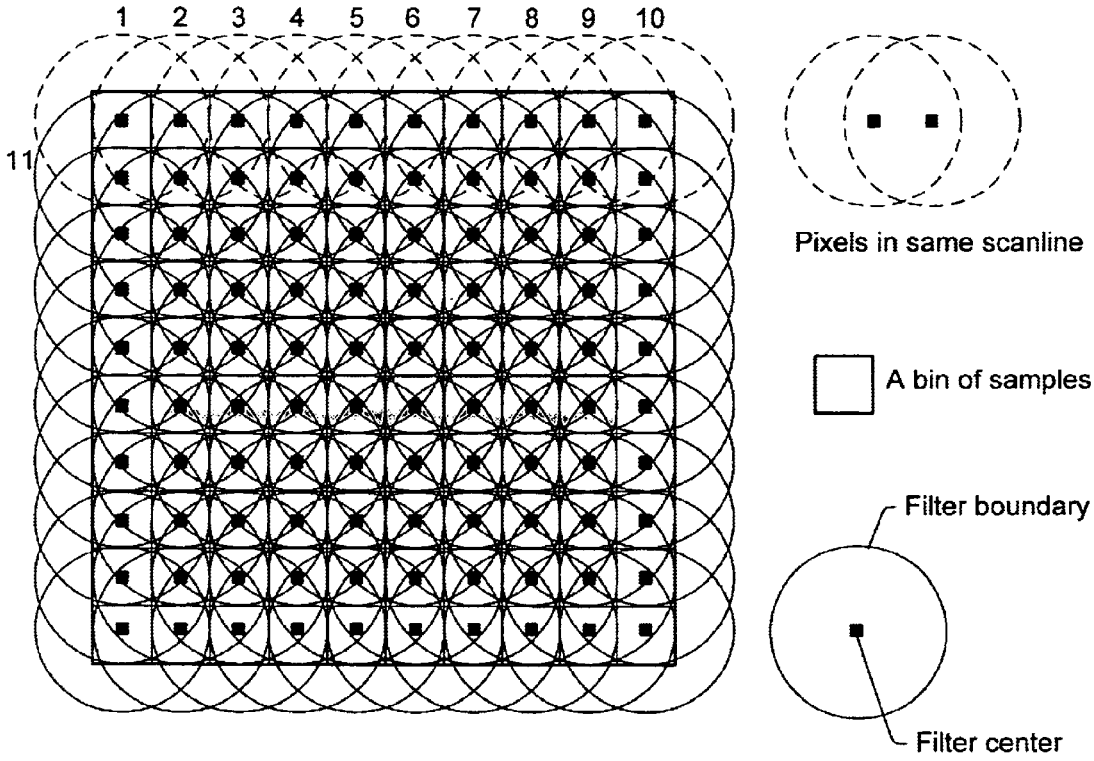
FIGS. 14 and 15 illustrate an example of a super-sample window using a Gaussian window.
Figure 15:
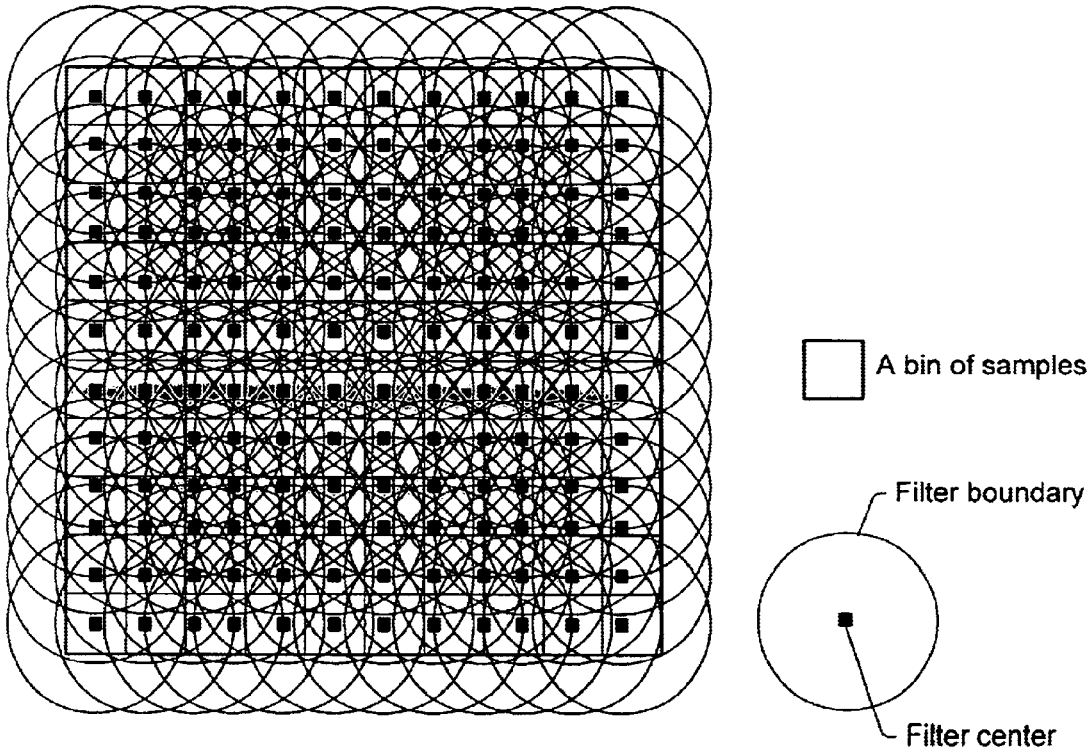

FIG. 14 illustrates an example of a super-sample window. The window is a 10×10 super-sample window with 10×10 sample bins, using a Gaussian filter with zoom =1. FIG. 15 illustrates another example of a super-sample window. The window is a 12×12 super-sample window with 10×10 sample bins, using a Gaussian filter with zoom=1.25.

In a first embodiment, pixels are filtered first in increasing x coordinates, then in increasing y coordinates. This is shown by the numbers 1–11 in FIG. 14, whereby the pixels in the top scan line are generated first (pixels 1–10), followed by the pixels in the next scan line (beginning with pixel 11) and so on. All filtered pixels in the same x coordinates form a scan line. For example, as shown in FIG. 14, all pixels represented by dotted circles form a scan line. Thus, this embodiment does not generate pixels in multiple neighboring scan lines for each read, but rather only generates one or more pixels in a single scan line for each read of the sample memory.

Figure 16:
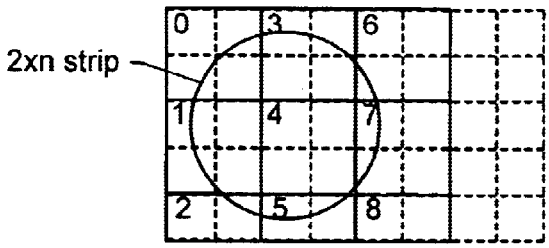
FIG. 16 illustrates a read of 2 full tiles and one half tile of samples into the cache for a sinc filter.

In the first embodiment, the filtering process may operate as follows. First, the samples may be read into a cache memory. The method may operate to read tiles into the cache memory to cover all the bins that the filter support region or footprint covers in a ymajor fashion. For example, the method may read a 2×n strip at a time. Since n can be odd, in one embodiment the method reads half tiles into the cache memory. For the sinc filter, n=5. Thus, for each strip, 2 full tiles and 1 half tile may be read. This read is illustrated in FIG. 16.

If the x address of the tile is greater than the edge of the filter for a pixel, then all the samples for the pixel have been read into the cache and the pixel may be now filtered. This may occur when:

$$xaddr > \text{filter_center}_i + \text{filter_radius})$$

Figure 17:
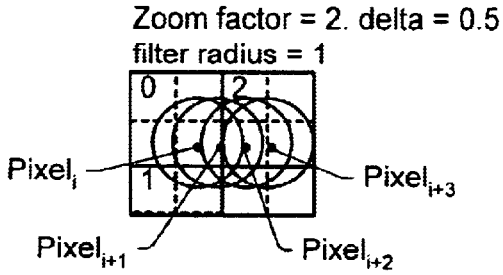
FIG. 17 illustrates an example read of samples using a cone filter whereby all of the samples for multiple pixels have been read into the cache after reading a 2×n strip.

However, depending on the size of the filter and the zoom factor, all the samples for multiple pixels may have been read into the cache after reading a previous 2×n strip. For example, FIG. 17 illustrates use of a cone filter which has a radius of 1 and a zoom factor of 2. As shown in FIG. 17, the samples for 4 pixels (all residing in the same scan line in this embodiment) were read into the cache memory after reading a single 2×n strip.

In order to filter samples into a pixel, the filter may require knowledge of the pixel center, the position of each sample, and the type of filter. The distance from the pixel center to a sample is given by a simple distance equation.

$$d=(dx^2+dy^2)^{1/2}$$

Figure 18:
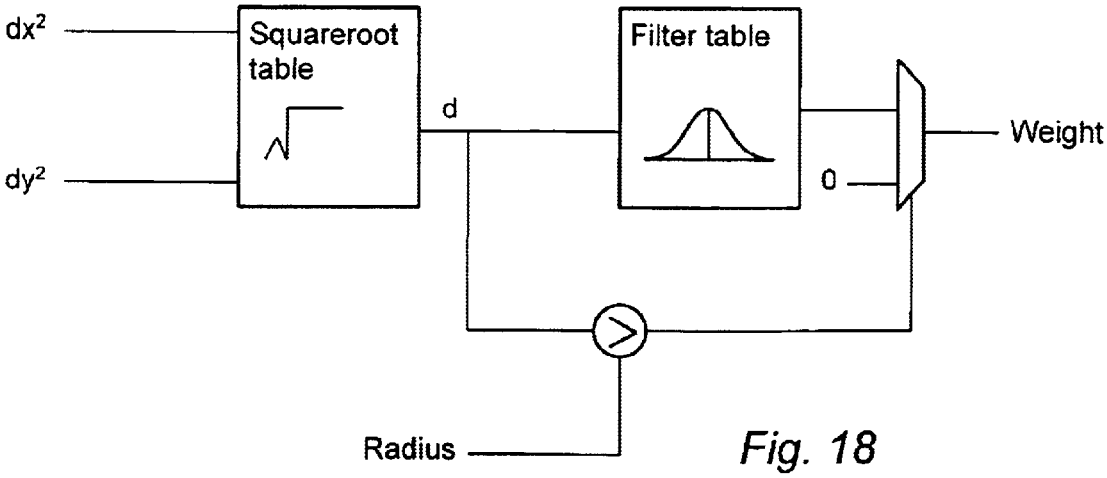
FIG. 18 is a block diagram of a filtering method that implements a distance equation to compute a distance d and accesses a filter table based on the distance d to generate a weight value.

The distance may be used to find the appropriate weight given the type of filter, e.g., using a table lookup. If the sample is outside the filter, then the weight is zero. FIG. 18 is a block diagram of a filtering method that implements the distance equation above and accesses a filter table based on the distance d to generate a weight value.

The weight of each sample is multiplied by the color of each sample and the result is accumulated. The result is divided by the sum of the weights, producing the filtered pixel color. The following filter equation may be used.

$$\frac{1}{\Sigma weight_i}\Sigma(weight_i \times sample_i)$$

After this, the next pixel center may be calculated using the reciprocal of the zoom factor, e.g.:

$$\text{pixel center}+=(\text{zoom factor})^{-1}$$

Multiple Scan Line Sample Filtering

As described above, a large amount of overlap may occur between samples in the footprint or support region of the filter applied to adjacent pixels. One embodiment of the invention recognizes this overlap both for neighboring pixels in the same scan line, and for neighboring pixels in adjacent scan lines. The method described above showed the reuse of samples when pixel filtering is performed in the x direction. However, as shown above, a large amount of overlap between samples in adjacent pixels may also occur in consecutive scan lines.

In one embodiment, a cache memory is used to store samples after they are read from the sample memory 22A, e.g., frame buffer 22. This may allow reuse of samples that have been already read for a neighboring filter operation. In addition, as described above, multiple filter commands may be generated or issued after samples for two or more pixels in adjacent scan lines (having the same x coordinates) have been read. This is because an access of samples for multiple pixels in adjacent scan lines may include the requisite samples for one or more neighboring pixels in the x direction. The reuse of samples for pixels in multiple scan lines (and adjacent pixels in the same scan lines) and access of samples from the cache memory that have been previously read are very important. This is because read of sample data from the sample buffer or frame buffer 22 is typically a bottleneck operation.

One embodiment of the present mention operates to take advantage of this overlap of samples between multiple x scan lines. This embodiment operates to filter multiple scan lines at a time, preferably 2 scan lines at a time. This operates to reduce accesses to both the cache memory and the sample memory.

Figure 19:
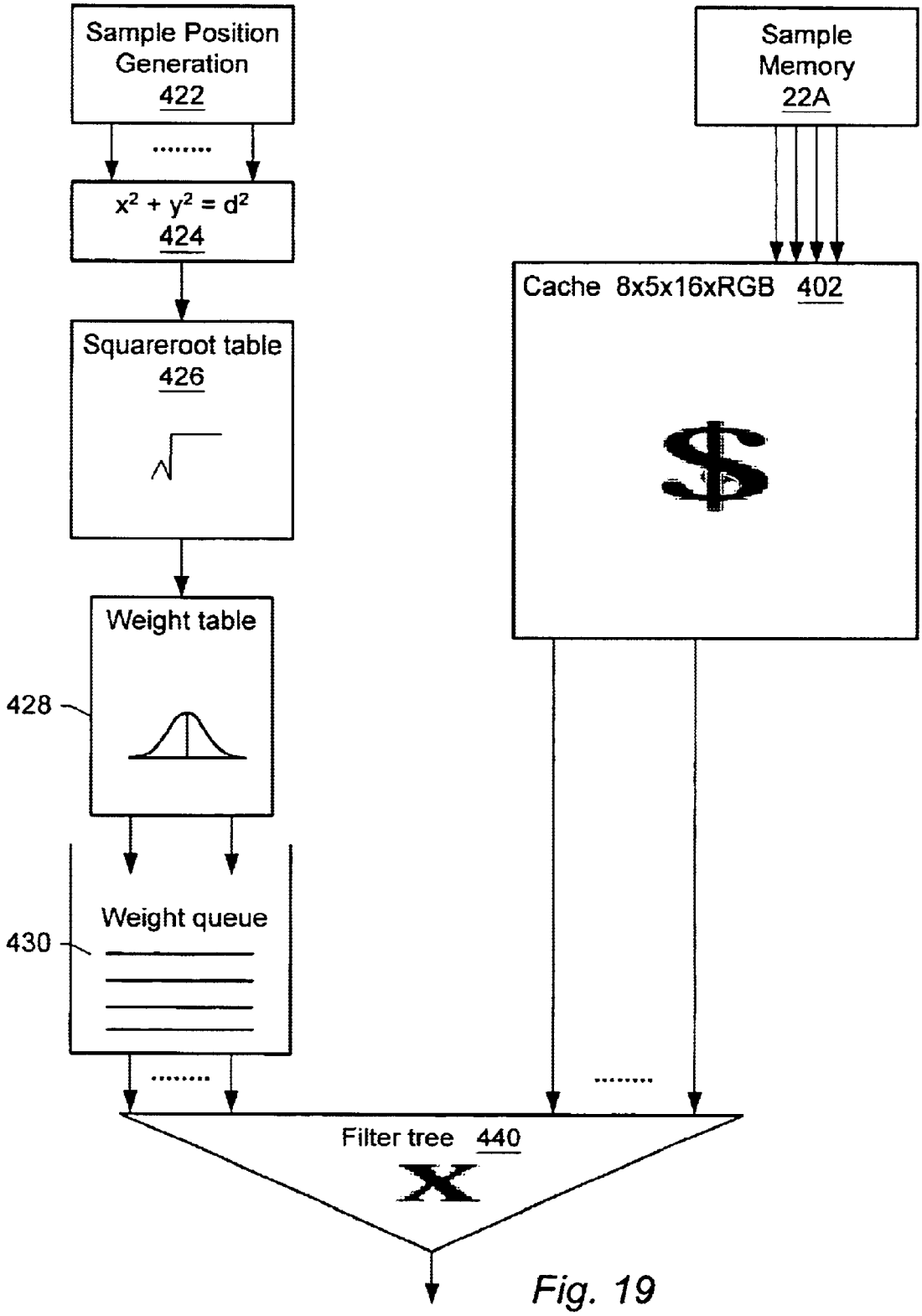
FIG. 19 illustrates is a block diagram of one embodiment of a sample filter.

FIG. 19—Sample Filter Embodiment

FIG. 19 is a block diagram of one embodiment of the sample filter 172. As shown, the sample filter 172 may include a sample position generation unit 422. The sample position generation unit 422 may include one or more jitter tables for jittering or adjusting sample positions. This may help to produce anti-aliasing in the final rendered image. The sample position generation unit 422 provides an output to a distance calculation unit 424 and 426. The distance calculation comprises computing the square root of $X^2+Y^2$ to produce the distance of the sample from the pixel center. The distance value computed may then be used to index into a weight table 428 to produce a weight value in a weight queue 430. The weight value may then be provided to a filter tree 440.

The sample memory 22A may be a portion of the frame buffer 22. The sample memory 22A may be accessed to obtain sample values for use in generating respective pixels. As mentioned above, in one embodiment of the invention, the method operates to access the sample memory 22A to retrieve samples corresponding to pixels in a plurality of neighboring scan lines, i.e., two or more scan lines. In other words, the sample memory 22A may be accessed to retrieve samples corresponding to pixels having the same x coordinates and residing in two or more horizontal rows or scan lines. This may operate to further reduce the amount of accesses to sample memory 22A. The samples read from the sample memory 22A may be stored in a cache memory 402 as shown. The samples may then be accessed from the cache memory 402 and provided to the filter tree 440. The filter tree 440 may multiply the sample values by respective weights from the weight queue 430 and perform an averaging function to produce the final pixel value.

Figure 20:
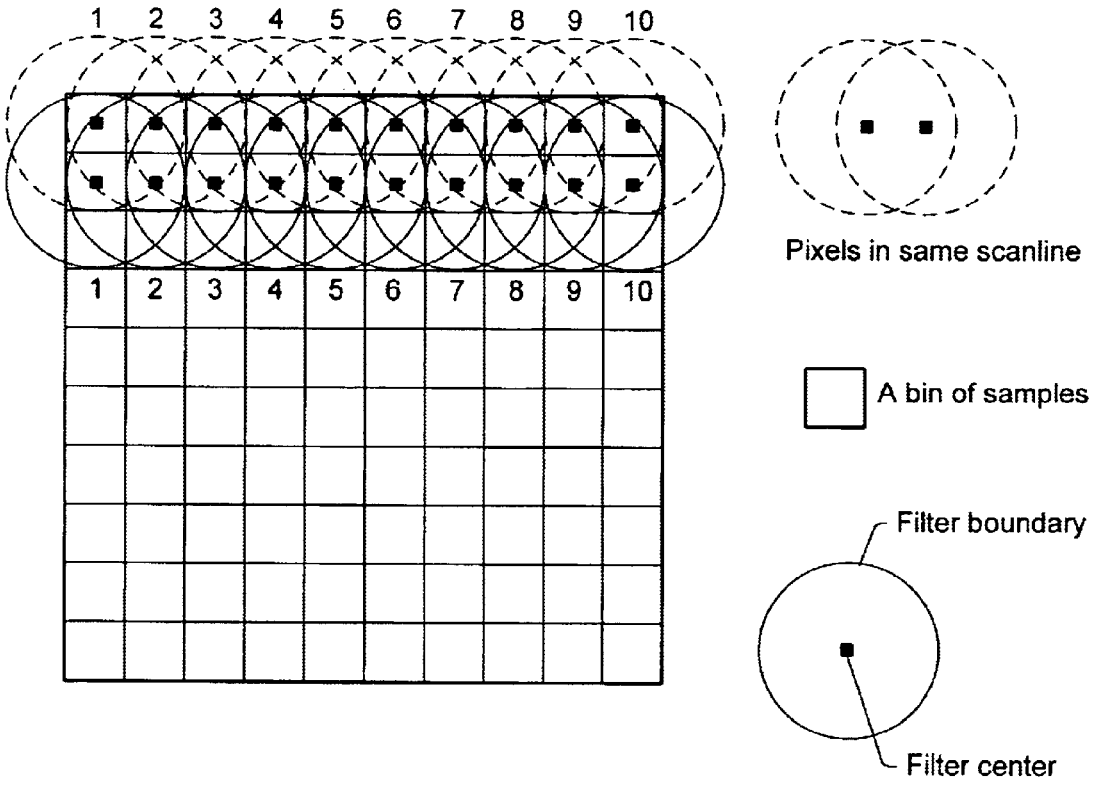
FIG. 20 illustrates an example of a super-sample window which shows multiple scan line processing.

FIG. 20 illustrates an example of a super-sample window which shows multiple scan line processing according to one embodiment of the invention. FIG. 20 illustrates an example of a 10×10 super-sample window with 10×10 sample bins using a Guassian filter with Zoom=1. All filtered pixels in the same x coordinates form a scan line, i.e., in FIG. 20 all pixels represented by dotted circles form a scan line.

FIG. 20 shows an embodiment where pixels from two neighboring scan lines are generated based on an access of sample data from the sample memory and/or cache memory. As shown, pixels are filtered in pairs of two of the same x coordinates. Two pixels of the same x coordinates are filtered at a time, wherein the pixels are generated first in increasing x coordinates, then in increasing y coordinates. FIG. 20 includes numbering which illustrates the order of filtering. As shown, pixels in the first scan line and second scan line in the first column have the number are filtered first, and are designated with the number 1. The two pixels in the second column are then filtered next etc. Thus, pairs of pixels having the same x coordinates are filtered in sequence from left to right, as shown by the numerals 1 through 10 in FIG. 20. This process may be repeated, generating two horizontal rows of scan lines per pass, until all scan lines have been rendered.

Figure 21:
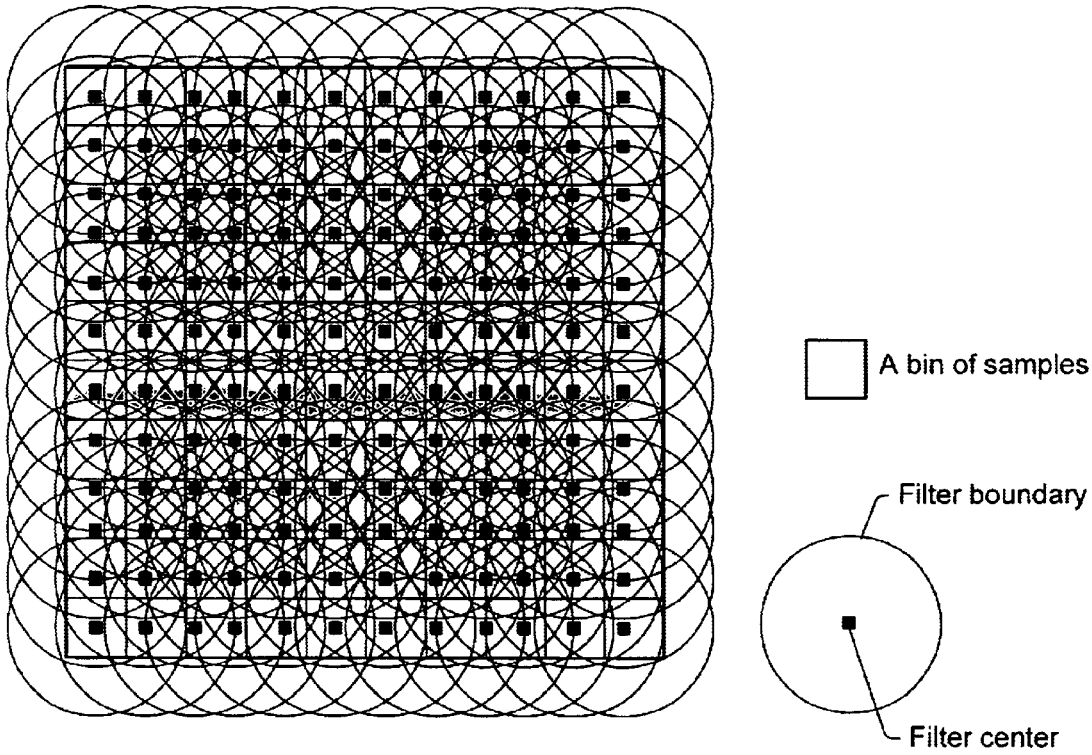
FIG. 21 illustrates an example of a 12×12 super-sample window with 10×10 sample bins and a Guassian filter with Zoom=1.25.

FIG. 21 illustrates an example of a super-sample of a 12×12 super-sample window with 10×10 sample bins and a Guassian filter with Zoom=1.25.

Figure 22:
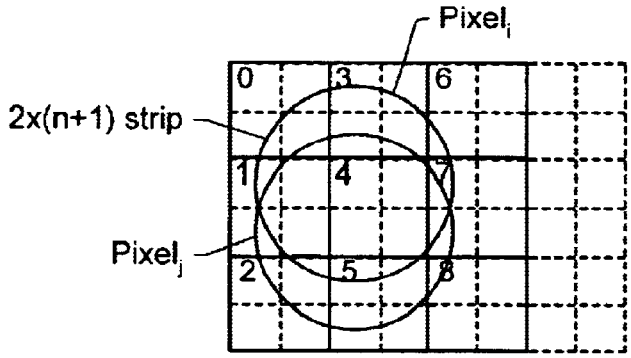
FIG. 22 illustrates the tile read order for a sinc filter which involves reading samples for pixels in a plurality of adjacent scan lines.

The method which involves multiple scan line processing as described herein may operate as follows. First, the method may read tiles of samples into the cache memory 402 in order to cover all of the bins that the union of the two filter footprints or support regions cover, in a ymajor fashion. In one embodiment, since the difference in y coordinates between the two centers is a maximum of 1, this results in an additional two pixels being read as compared to the single scan line method described above with respect to FIGS. 14–18. Thus, the method reads in a 2X(n+1) strip at a time. Since n can be odd, the method may operate to read half tiles into the cache 402. In an example using a Sinc filter where n=5, for each 2X(n+1) strip, 3 full tiles are read. This is illustrated in FIG. 22. As shown, FIG. 22 illustrates the tile read order for a Sinc filter. As shown, the read operates to read samples for 2 pixels, i and j, having the same x coordinates, and residing in neighboring scan lines.

Figure 23:
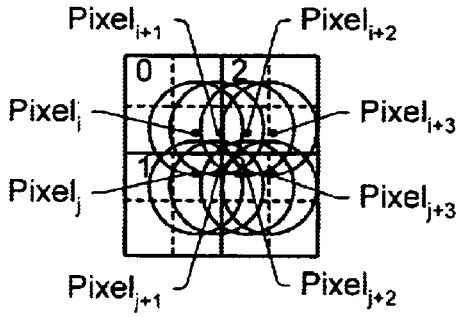
FIG. 23 illustrates an example whereby all of the samples for multiple pixels in multiple scan lines have been read into the cache after reading a 2×(n+1) strip.

The filtering operation may be performed when all of the requisite samples have been obtained for the pixel being generated. This may occur when the x address of the tile is greater than the edge of the filter for the respective pixel, $$i.e., \ if\ (xaddr > \text{filter_center}_i + \text{filter_radius}),$$

then all the samples for $\text{pixel}_i$ and $\text{pixel}_j$ have been read into the cache 402, and $\text{pixel}_i$ and $\text{pixel}_j$ may be filtered. However, depending on the size of the filter and the zoom factor, all the samples for multiple pixels in each of multiple scan lines may have been read into the cache 402 after reading a 2X(n+1) strip. For example, consider the cone filter which has a radius of 1 and a zoom factor 2, as shown in FIG. 23. In this example, the samples for 8 pixels were read into the cache 402 after reading a single 2X(n+1) strip. In one embodiment, both $\text{pixel}_i$ and $\text{pixel}_j$ (having the same x coordinates and residing in neighboring scan lines) are filtered in parallel. In other embodiments, the system may include additional filters and thus an even larger number of pixels may be filtered in parallel as desired.

The filtering operation may be performed as follows. As described above, in order to filter samples into a pixel, the filter may require knowledge of the pixel center, the position of each sample, and the type of filter. The distance from the pixel center to a sample is given by a simple distance equation.

$$d=(dx^2+dy^2)^{1/2}$$

The distance may be used to find the appropriate weight given the type of filter, e.g., using a table lookup. If the sample is outside the filter, then the weight is zero. As described above, FIG. 18 is a block diagram of a filtering method that implements the distance equation above and accesses a filter table based on the distance d to generate a weight value. The weight of each sample is multiplied by the color of each sample and the result is accumulated. The result is divided by the sum of the weights, producing the filtered pixel color. The filter equation described above may be used.

In one embodiment, the system includes a plurality of filter and weight units corresponding to the plurality of pixels in neighboring scan lines being rendered in parallel. For example, in an embodiment where 2 pixels (having the same x coordinates and residing in neighboring scan lines) are being rendered in parallel, the system has 2 filter and weight units.

The pixel center of $\text{pixel}_j$ can be derived from $\text{pixel}_i$ as follows:

$$\text{pixel center of } j = \text{pixel center of } i + (\text{zoom factor})^{-1}$$

After this, the next pixel center(s) may be calculated using the reciprocal of the zoom factor in the x direction $$\text{pixel center} += (\text{zoom factor})^{-1}$$

However, in the y direction, after two or more scan lines have been completely processed and the system is advancing to begin at the next group of multiple scan lines, since multiple (e.g., 2) scan lines are being processed at one time, the pixel center is moved by a multiple of this amount in the y direction, the multiple being dependent on the number of scan lines being processed in parallel. For example, where 2 scan lines are being processed at one time, the pixel center is moved by twice this amount.

Figure 24:
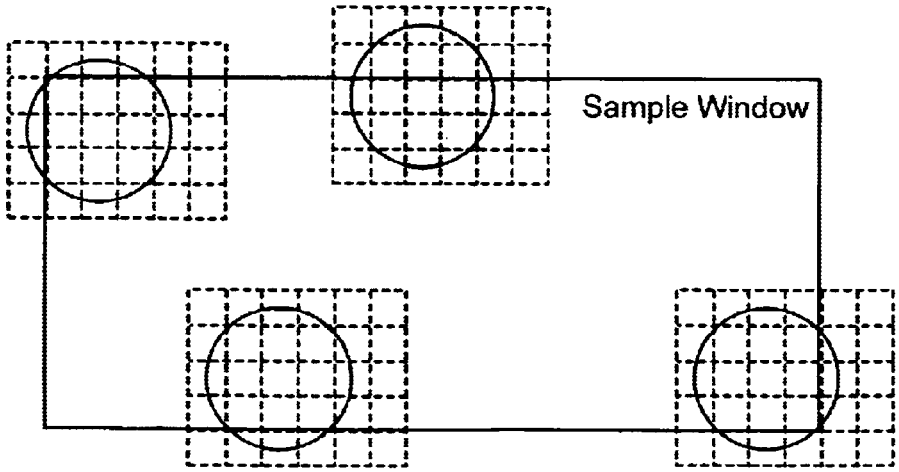
FIG. 24 illustrates various special border cases.
Figure 25:
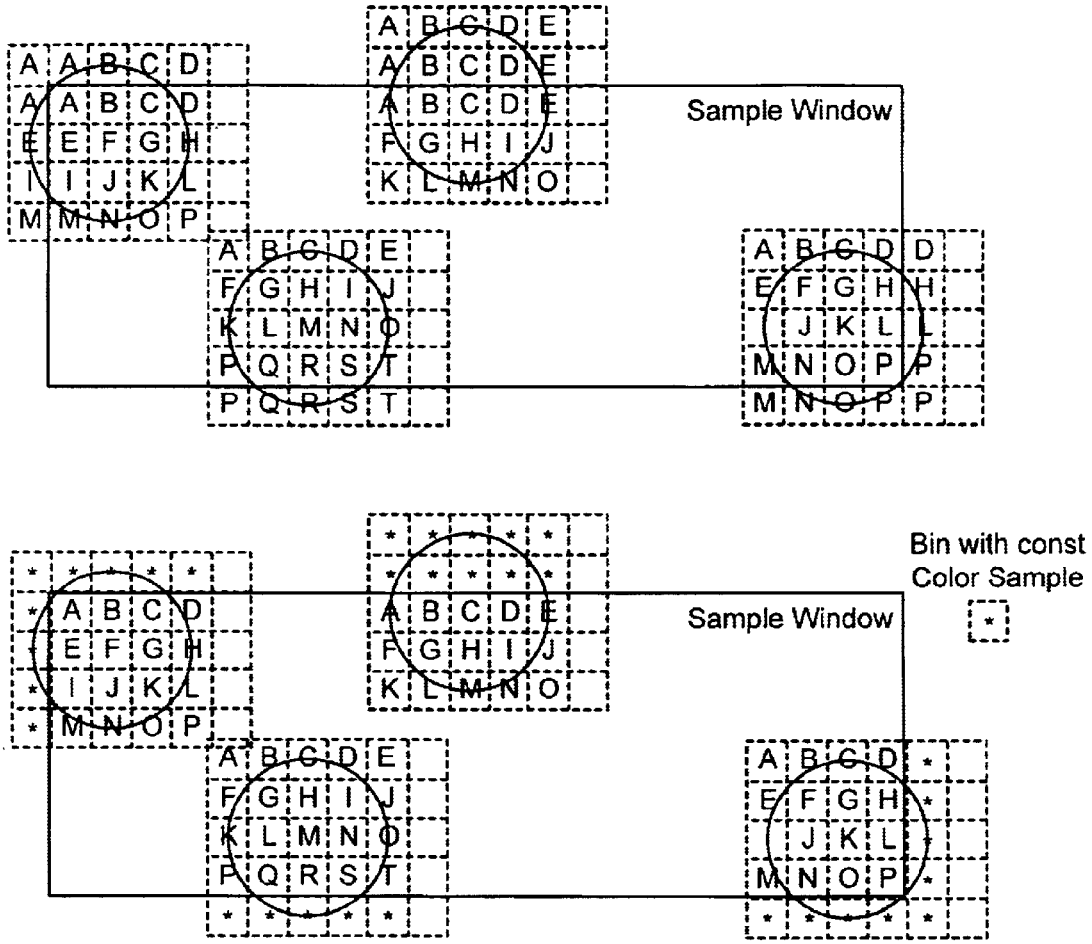
FIG. 25 illustrates a replication mode where the samples in the bins that fall outside of the window may be replaced with its mirror bin's samples.

FIG. 24 illustrates various special border cases. As shown, bins may fall outside the window when filtering a border pixel. Examples of this are shown in FIG. 24. In these instances, the samples are undefined. In these types of cases, the system may operate according to one of the following embodiments. In a background mode, the samples in the bins that fall outside of the window may be replaced with a background color specified by the user. In a replication mode, the samples in the bins that fall outside of the window may be replaced with its mirror bin's samples. An example of this is shown in FIG. 25.

The sample filter 172 basically comprises the following blocks: the span walker (SW), the sample generator (SG), the frame buffer addressing unit (FBA) and the frame buffer readback unit (FRB).

Figure 26:
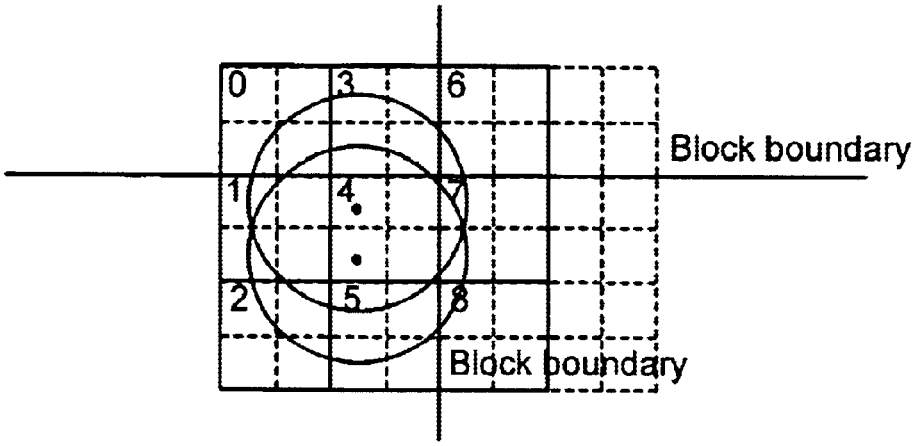
FIG. 26 illustrates an example read order for the span walker.

The span walker's responsibility is to issue sample read and filter commands to the FBA. Each read command gives an integer x, y address of the upper lefthand corner of the tile to be read. Each pixel tile sent by SW may be either a full tile (2×2) or a horizontal half tile (2×1). In that way, the FBA can maximize the read throughput and expand the pixel tile in a regular fashion. The span walker issues read tile commands walking the area of the filter in a ymajor fashion. Therefore, the span walker is actually reading 2X(n+1) strips where n is the height of the footprint embracing the filters. The span walker will also avoid straddling block boundaries. An example of the read order is shown in FIG. 26. As shown, the read order proceeds in the order from 0 to 8.

Figure 27:
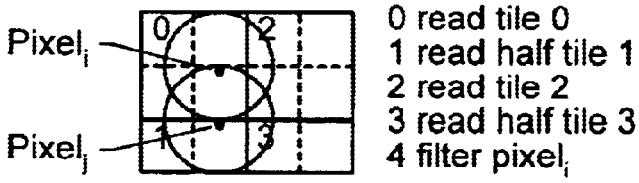
FIG. 27 illustrates illustrates an example of issuing a filter command for one pixel pair.

In determining when to issue filter commands, where the method is about to read a new 2X(n_1) strip, the x address is examined. If this x address is greater than the edge of the filter, then a filter command is sent for this pixel pair. Therefore, the span walker uses knowledge of the radius, center, and zoom factor of the filter. FIG. 27 illustrates an example of issuing a filter command for one pixel pair.

Figure 28:
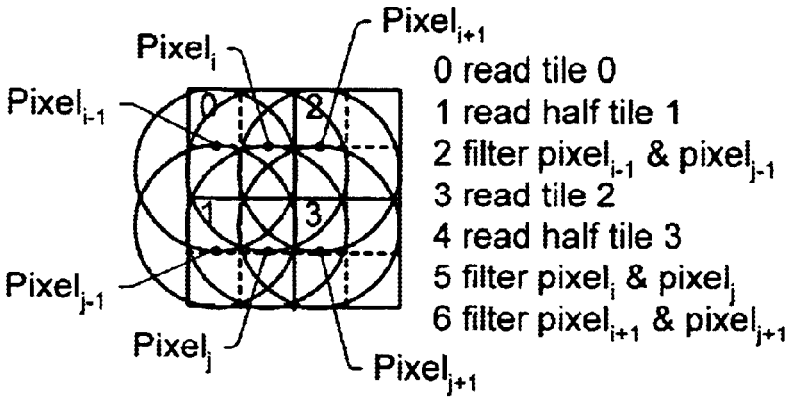
FIG. 28 illustrates an example of issuing filter commands for multiple pixel pairs.

However, it is possible, after reading a 2X(n+1) strip, that enough samples may have been read for more than 1 pixel pair. Therefore, the method may consider more than 1 pixel pair and send down filter commands for more than 1 pixel pair as well. FIG. 28 illustrates an example of issuing filter commands for multiple pixel pairs.

Figures 29, 30:
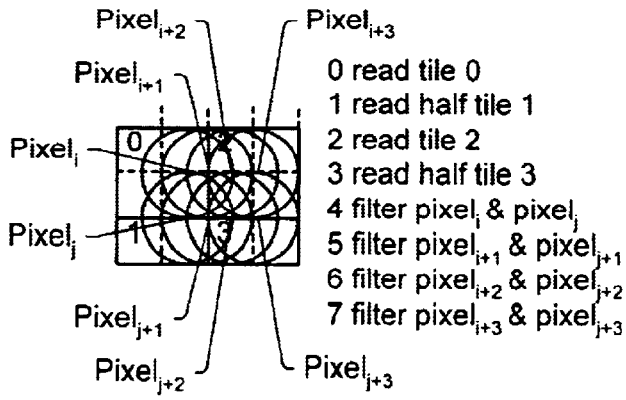
FIG. 29 illustrates an example of the maximum number of pixels that can be filtered by reading a 2×n strip in one embodiment.
FIG. 30 is a table illustrating 3DRAM interleave enable assignments for sample density in one embodiment.

As shown in FIG. 28, it is possible that the method may issue a number of consecutive filter commands. Therefore, the span walker may be required to keep track of a number of pixels. In one embodiment, the maximum that the span walker considers is 8. An example of how this extreme case can be achieved is shown in FIG. 29. FIG. 29 illustrates an example of the maximum number of pixels that can be filtered by reading a 2Xn strip in one embodiment.

A filter command comprises the pixel center in fixed point arithmetic. The span walker will also add the reciprocal of the zoom factor to produce the new pixel center.

During read sample operations, frame buffer address (FBA) is responsible for receiving pixel (bin) tiles from span walker (SW) and expanding them into sample tiles in a regular fashion according to sample packing rules. In one embodiment, as shown in FIG. 30, each sample density follows a table of 3DRAM interleave enable assignment.

Figure 31:
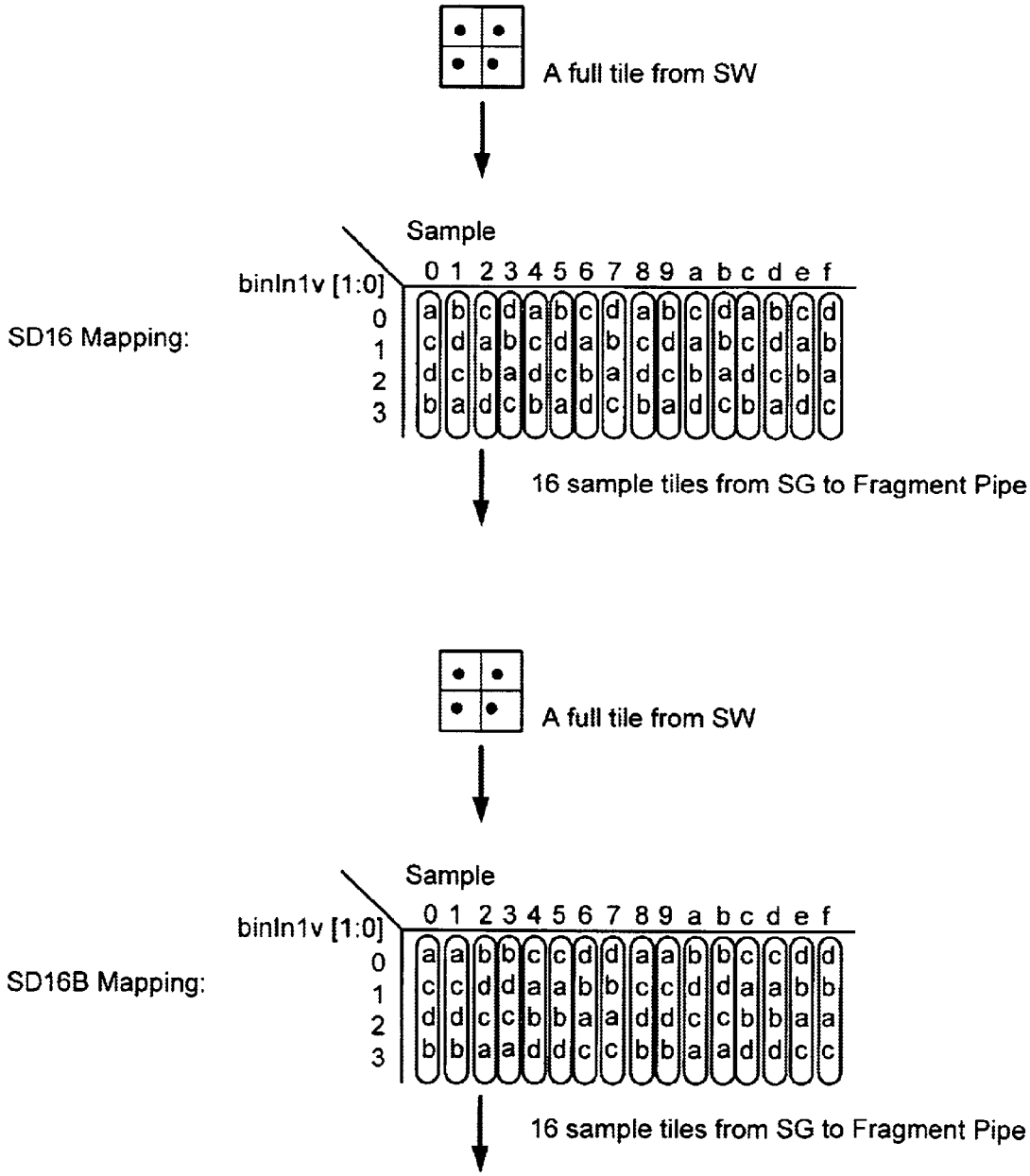
FIGS. 31 and 32 illustrate expansion of a pixel tile into sample tiles in a regular fashion.
Figure 32:
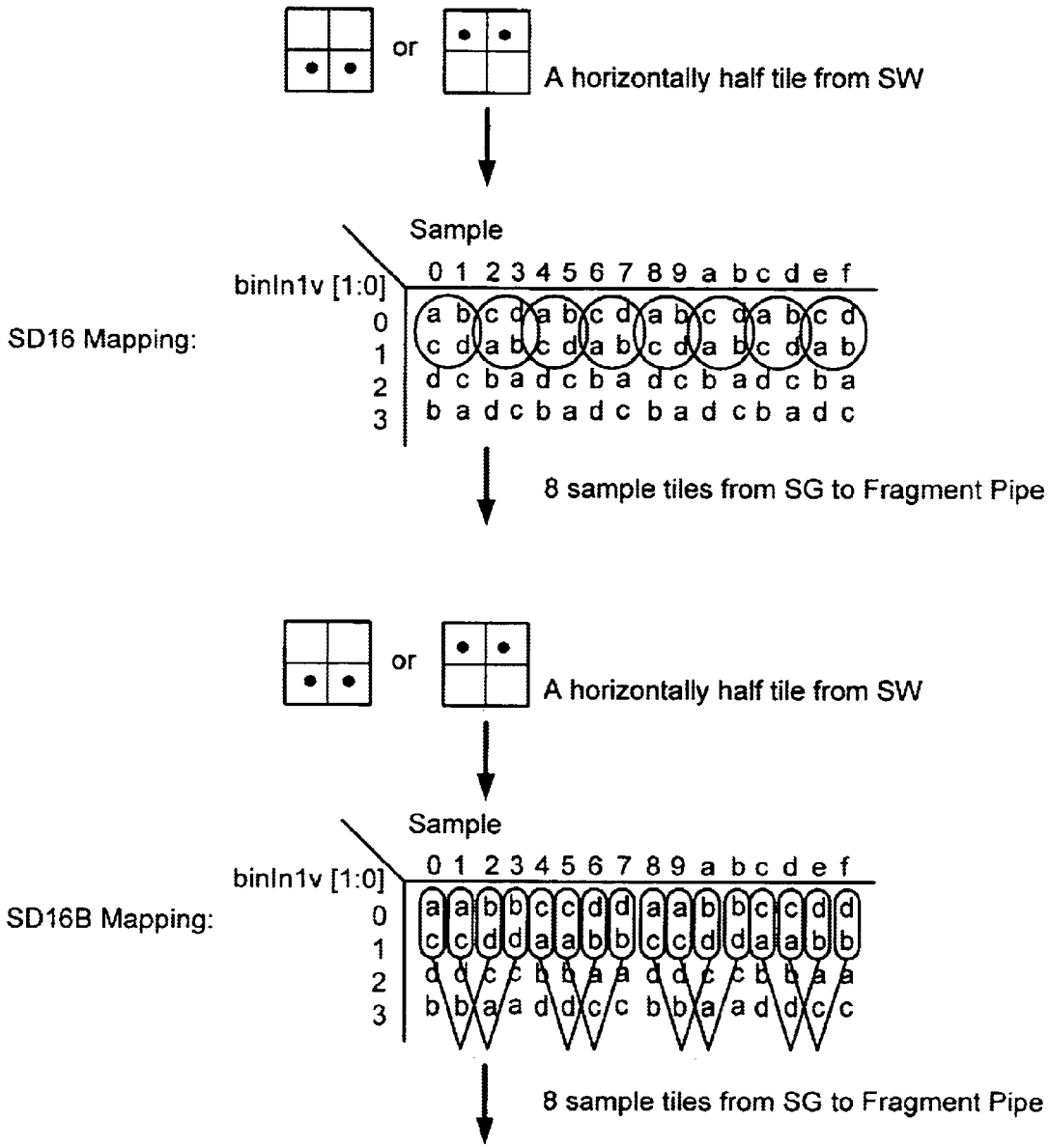

Since in the current embodiment the pixel tiles from SW is limited to either a full tile (2×2) or a horizontal half tile (2×1), SG can expand a pixel tile into sample tiles in a regular fashion. FIGS. 31 and 32 summarize the expansion taken place in SG.

Figure 33:
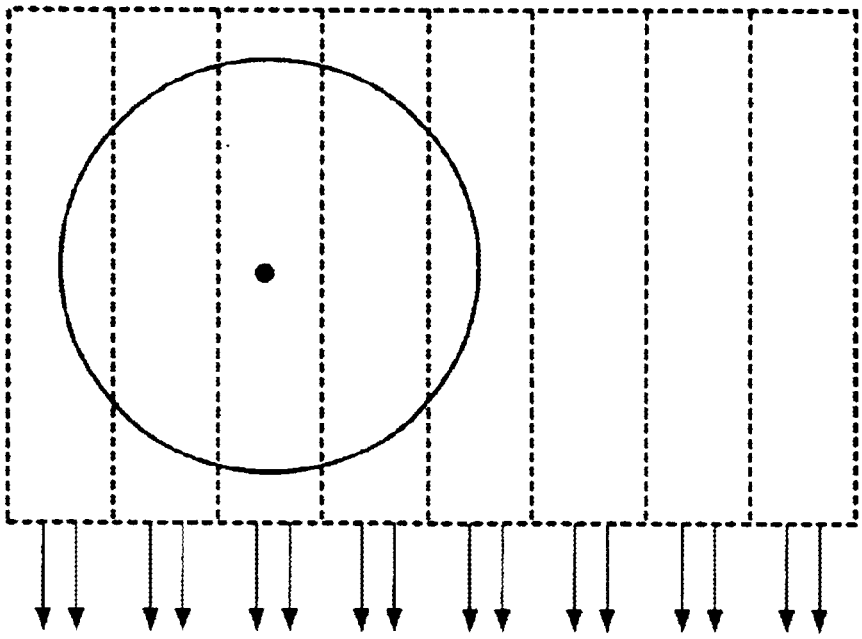
FIG. 33 illustrates the cache organization and cache read ports according to one embodiment.
Figure 34:
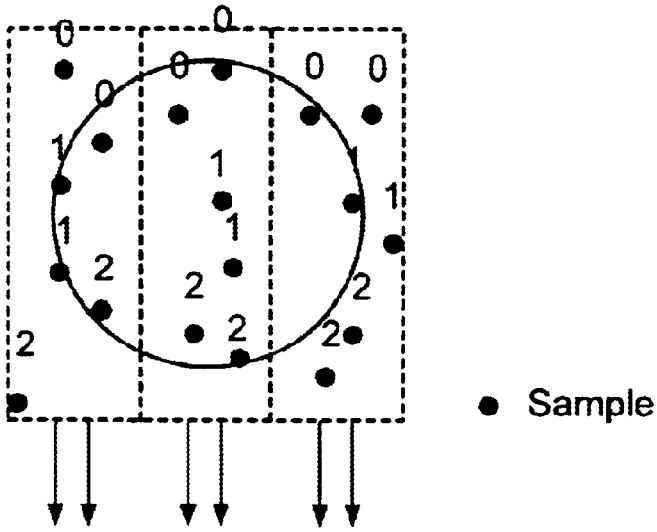
FIG. 34 illustrates an exemplary weight computation order and filter order.

The FRB performs the actual filtering of the samples. When FRB receives a read-sample command, it stores the samples read out from frame buffer memory into its cache. The sample cache can hold samples belonging to an area of 8×6 bins. The cache is made up of 8 separate 1×6 strip (column), each a 2-port memory. When the FRB receives a filter command, it first calculates the weight for each sample. This may be done using a jitter table and a mirror table to compute the position of a given sample in a bin. The distance between a sample and the pixel center is used to lookup a weight in a filter table. The samples are "visited" in the order of the easiest way to read samples out of the cache. The FRB reads samples out in an xmajor fashion. Since in one embodiment the maximum filter size is 5 columns, the filter has been made to handle 10 samples at a time. Therefore, the weights are computed for the first two samples in each column, and then the next two samples in each column and so on. FIG. 33 shows the cache organization and read ports.

Figure 36:
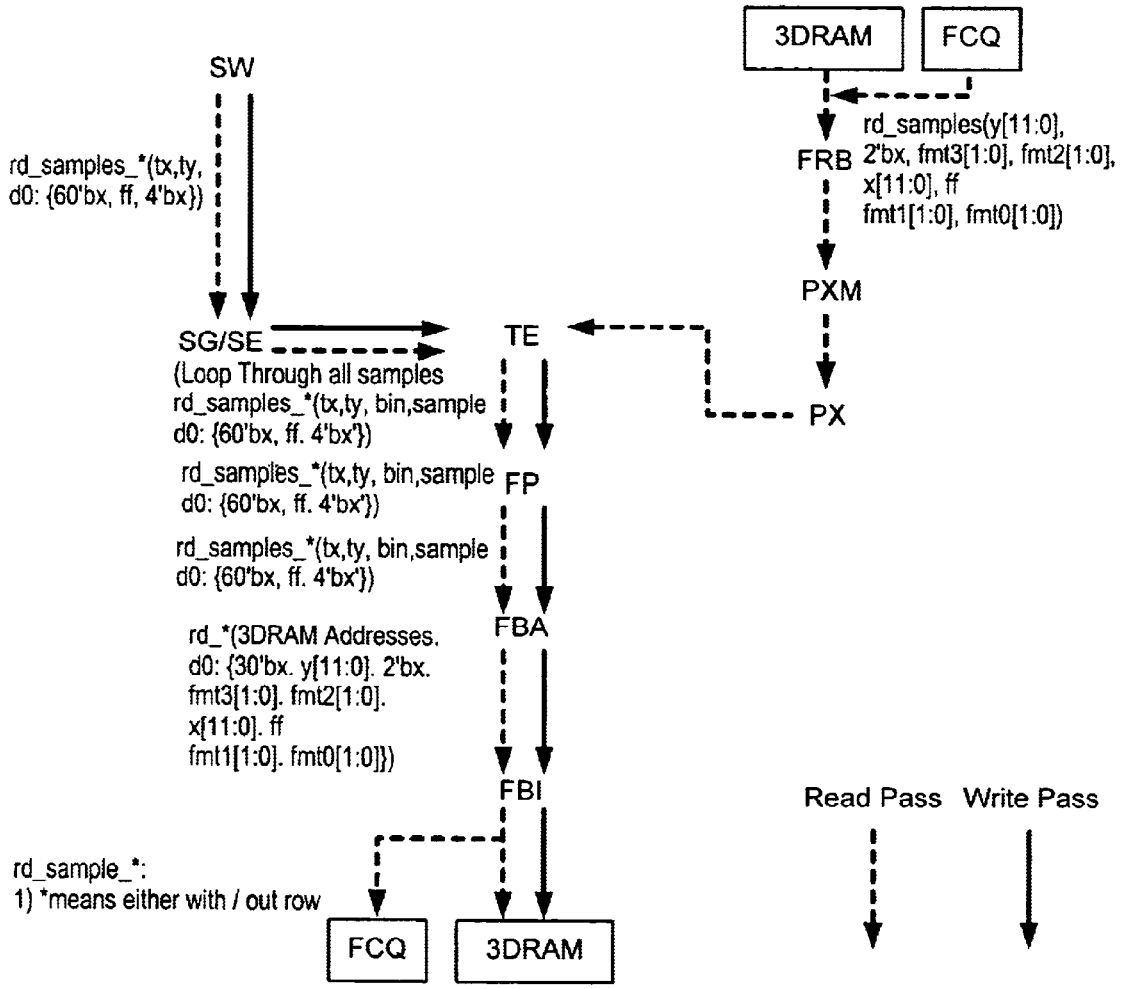
FIG. 36 illustrates the super-sample read pass opcode flows.

Once the weights have been computed, they are placed in a queue where they wait to be filtered. In the current embodiment, the filter can handle up to 10 samples at a time and multiplies the sample color by the weights. The results are accumulated and divided by the sum of the weights to get the resulting pixel. The samples are filtered in the same order that the weight computation was done. FIG. 36 shows the order in which the samples are visited for a specific example.

FRB includes 2 units to handle filtering for the 2 scan-lines. Each cycle, the same 10 samples are read out, and sent to the 2 units respectively. The "distance from pixel center" is calculated separately for the 2 units, and hence the corresponding weight will be selected for the same sample, but with respect to 2 different filter centers.

Figure 35:
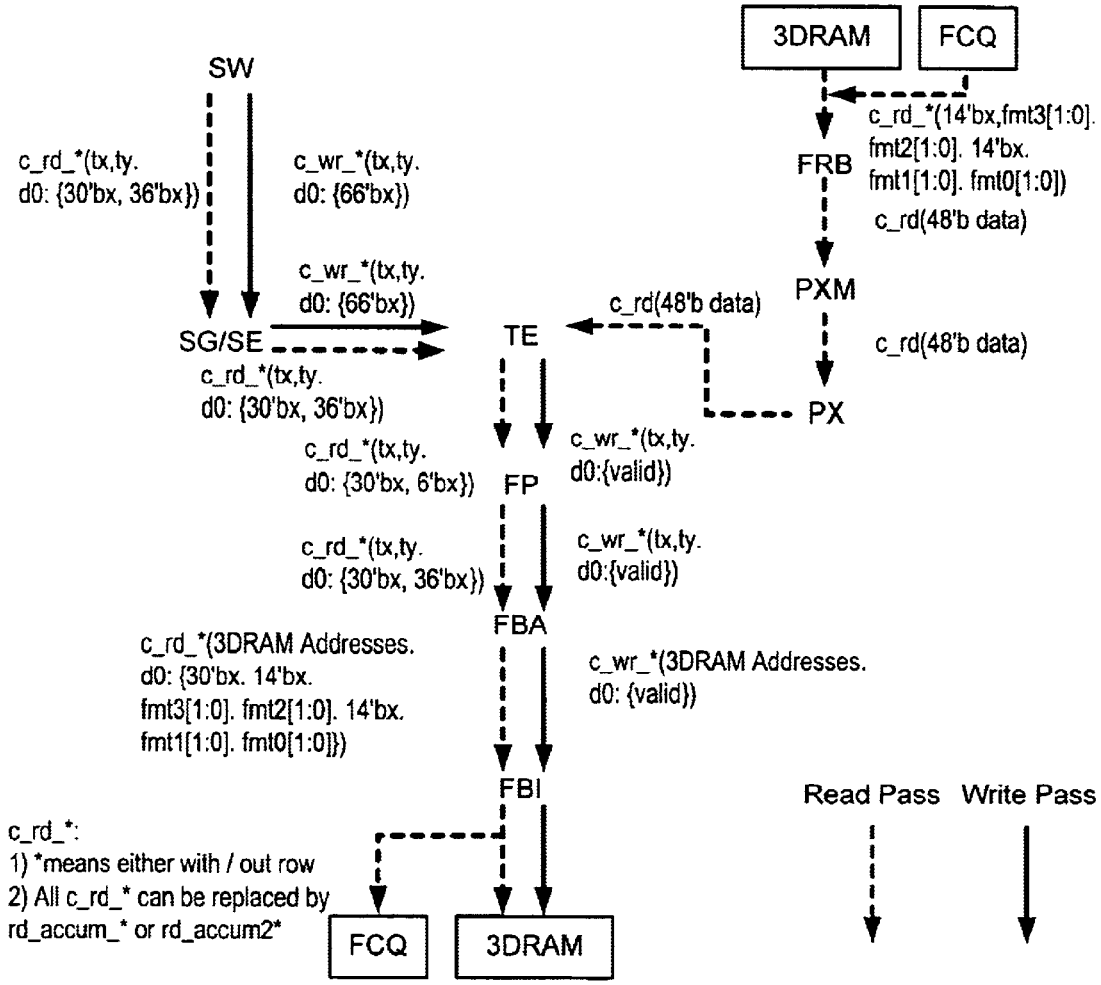
FIG. 35 illustrates the opcode flow from the SW to FRB during a regular copy read.
Figure 37:
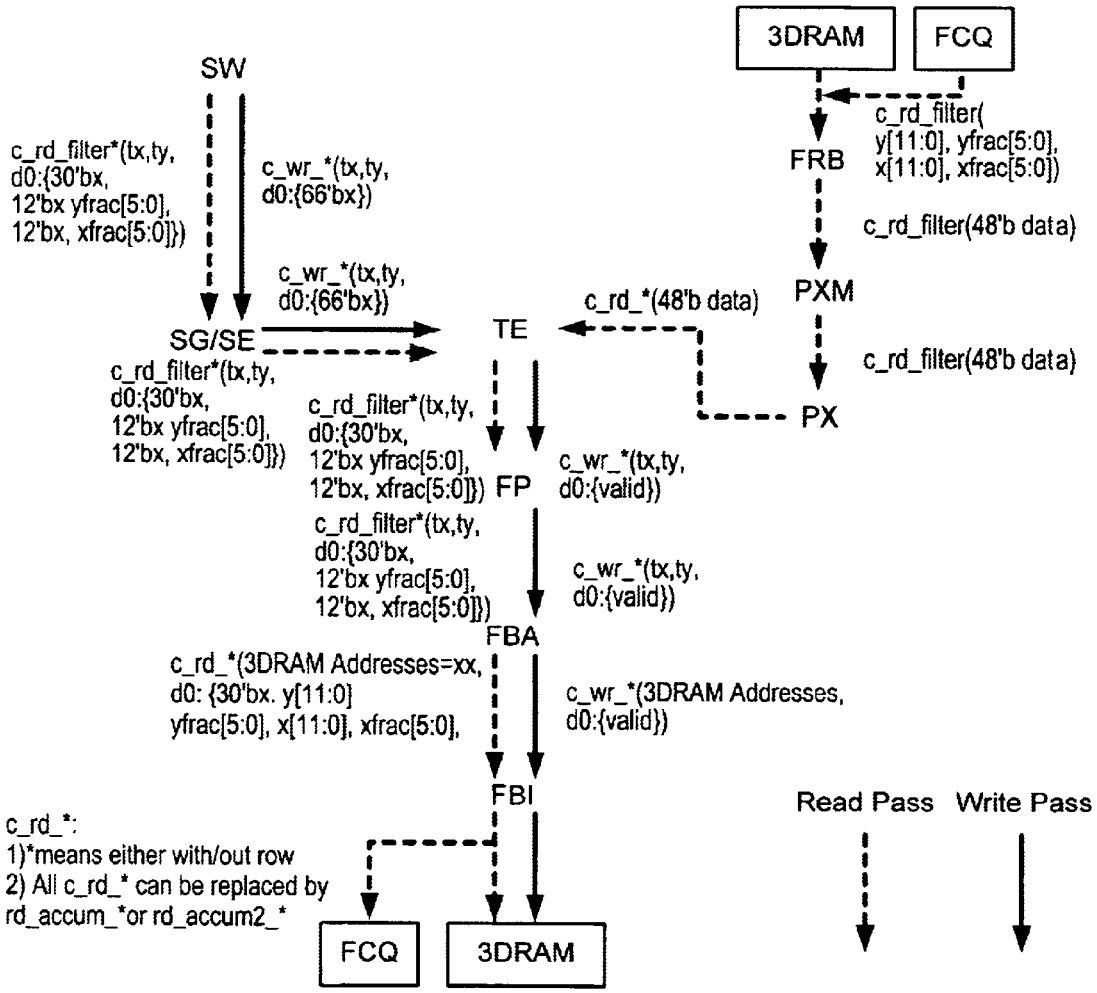
FIG. 37 illustrates the super-sample filter pass opcode flows.

The filter process described in the previous sections involving SW, SG, FBA and FRB can be summarized in an "opcode flows" diagram. FIG. 35 shows the opcode flow from SW to FRB during a regular copy read. This Figure is used as a comparison. FIG. 36 shows the super-sample read pass (SS buffer->FB) opcode flows. FIG. 37 shows the super-sample filter pass(SS buffer->FB) opcode flows.

Although the embodiments above have been described in considerable detail, other versions are possible. Numerous variations and modifications will become apparent to those skilled in the art once the above disclosure is fully appreciated. It is intended that the following claims be interpreted to embrace all such variations and modifications. Note the section headings used herein are for organizational purposes only and are not meant to limit the description provided herein or the claims attached hereto.

What is claimed is:

1. A method for generating pixels for a display device, the method comprising:

rendering a plurality of samples from vertex data, wherein each sample is rendered for a specific point in screen space;

storing the plurality of samples in a memory;

storing a first portion of samples in a cache memory, wherein the first portion of samples is selected from the plurality of samples and corresponds to pixels in at least two neighboring scan lines;

filtering a first subset of the first portion of samples to generate a first pixel in a first scan line; and filtering a second subset of the first portion of samples to generate a second pixel in a second scan line, wherein the second scan line neighbors the first scan line.

2. The method of claim 1, wherein the first subset of the first portion of samples includes a plurality of common samples with the second subset of the first portion of samples.

3. The method of claim 1, wherein said filtering the first subset comprises accessing the first subset of the first portion of samples from the cache memory, and wherein said filtering the second subset comprises accessing the second subset of the first portion of samples from the cache memory.

4. The method of claim 3, further comprising:

accessing a third subset of the first portion of samples from the cache memory;

filtering the third subset of the first portion of samples to generate a third pixel in the first scan line, wherein the third pixel neighbors the first pixel in the first scan line;

accessing a fourth subset of the first portion of samples from the cache memory; and filtering the fourth subset of the first portion of samples to generate a fourth pixel in the second scan line, wherein the fourth pixel neighbors the second pixel in the second scan line.

5. The method of claim 1, further comprising:

reading a second portion of samples from the memory, wherein the second portion of samples corresponds to pixels in the at least two neighboring scan lines, wherein the second portion of samples neighbors the first portion of samples;

filtering a first subset of the second portion of samples to generate a third pixel in the first scan line; and filtering a second subset of the second portion of samples to generate a fourth pixel in the second scan line.

6. The method of claim 5, wherein the third pixel neighbors the first pixel in the first scan line; and wherein the fourth pixel neighbors the second pixel in the second scan line.

7. The method of claim 1, wherein the first subset of the second portion of samples includes a plurality of common samples with the first subset of the first portion of samples; and wherein the second subset of the second portion of samples includes a plurality of common samples with the second subset of the first portion of samples.

8. The method of claim 1, further comprising: performing said storing portions of samples in the cache memory, and said steps of filtering a plurality of times to generate all pixels in the first and second scan lines.

9. A method for generating pixels for a display device, the method comprising:

rendering a plurality of samples from vertex data, wherein each sample is rendered for a specific point in screen space;

storing the plurality of samples in a memory;

reading a first portion of samples from the memory, wherein the first portion of samples corresponds to pixels in at least two neighboring scan lines;

storing the first portion of samples in a sample cache; and filtering respective subsets of the first portion of samples in the sample cache to generate a plurality of respective pixels, wherein the plurality of respective pixels are in a plurality of scan lines.

10. The method of claim 9, wherein each of the respective subsets of the first portion of samples includes a plurality of common samples with another one of the respective subsets of the first portion of samples.

11. The method of claim 9, wherein the plurality of scan lines comprises 2 scan lines.

12. The method of claim 9, wherein the plurality of scan lines comprises greater than 2 scan lines.

13. The method of claim 9, wherein said filtering respective subsets comprises:

filtering a first subset of the first portion of samples to generate a first pixel in a first scan line; and filtering a second subset of the first portion of samples to generate a second pixel in a second scan line, wherein the second scan line neighbors the first scan line.

14. The method of claim 9, wherein said filtering respective subsets of the first portion of samples comprises accessing the respective subsets of the first portion of samples from the cache memory.

15. The method of claim 14, further comprising:

accessing different respective subsets of the first portion of samples from the cache memory; and filtering the different respective subsets of the first portion of samples to generate a different plurality of respective pixels, wherein the different plurality of respective pixels are in the plurality of scan lines.

16. A graphics system, comprising:

a memory for storing a plurality of samples, wherein each sample is rendered for a specific point in screen space; and a filter unit comprising a cache memory operable to:

read a first portion of samples from the memory, wherein the first portion of samples corresponds to pixels in at least two neighboring scan lines;

store the first portion of samples in the cache memory;

filter a first subset of the first portion of samples to generate a first pixel in a first scan line; and filter a second subset of the first portion of samples to generate a second pixel in a second scan line, wherein the second scan line neighbors the first scan line, and wherein the pixels are usable in presenting an image on a display device.

17. A graphics system, comprising:

a first means for storing a plurality of samples, wherein each sample is rendered for a specific point in screen space;

means for reading a first portion of samples from the plurality of samples, wherein the first portion of samples corresponds to pixels in at least two neighboring scan lines;

a second means for storing the first portion of samples; and means for filtering respective subsets of the first portion of samples to generate a plurality of respective pixels, wherein the plurality of respective pixels are in a plurality of scan lines.

* * * * *